US005178983A

United States Patent [19]

Kato et al.

[11] Patent Number: 5,178,983

[45] Date of Patent: Jan. 12, 1993

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 524,956

[22] Filed: May 18, 1990

[30] Foreign Application Priority Data

May 19, 1989 [JP] Japan ..... 1-124551

[51] Int. Cl.[5] ..... G03G 5/00

[52] U.S. Cl. ..... 430/96

[58] Field of Search ..... 430/96

[56] References Cited

U.S. PATENT DOCUMENTS 5,009,975 4/1991 Kato et al. ..... 430/96
5,021,311 6/1991 Kato et al. ..... 430/96
5,064,737 11/1991 Kato et al. ..... 430/96

FOREIGN PATENT DOCUMENTS 0307227 3/1989 European Pat. Off. .
1806414 8/1969 Fed. Rep. of Germany .

OTHER PUBLICATIONS

Patent Abstracts of Japan, vol. 13, No. 9, Jan. 11, 1989.
Patent Abstracts of Japan, vol. 13, No. 342, Aug. 2, 1989.

*Primary Examiner*—Marion E. McCamish
*Assistant Examiner*—S. Crossan
*Attorney, Agent, or Firm*—Sughrue, Mion, Zinn, Macpeak & Seas

[57] ABSTRACT

An electrophotographic light-sensitive material comprising a support having thereon a photoconductive layer containing at least inorganic phohtoconductive particles and a binder resin, wherein the binder resin contains (A) at least one resin comprising a graft copolymer having a weight average molecular weight of from $1.0\times10^3$ to $2.0\times10^4$ and containing, as copolymer components, at least (i) a monofunctional macromonomer (M) having a weight average molecular weight of not more than $2\times10^4$ and containing at least one polymer component represented by formula (IIa) or (IIb) shown below and at least one polymer component having at least one polar group selected from the group consisting of —COOH, $-PO_3H_2$, $-SO_3H$, —OH, and wherein $R_1$ represents a hydrocarbon group or $-OR_2$ (wherein $R_2$ represents a hydrocarbon group), with a polymerizable double bond group represented by formula (I) shown below being bonded to one terminal of the main chain thereof, and (ii) a monomer represented by formula (III) shown below, and (B) at least one resin having a weight average molecular weight of not less than $5\times10^4$, containing at least a recurring unit represented by formula (IV) shown below as a polymer component, and having a crosslinked structure (I)

wherein $X_0$ represents —COO—, —OCO—, $-CH_2OCO-$, $-CH_2COO-$, —O—, $-SO_2$, —CO—, —CONHCOO—, —CONHCONH—, $-CONHSO_2-$, wherein $R_{11}$ represents a hydrogen atom or a hydrocarbon group; $a_1$ and $a_2$, which may be the same or different, each represents a hydrogen atom, a halogen atom, a cyano group, a hydrocarbon group, $-COO-Z_1$, or $-COO-Z_1$ bonded through a hydrocarbon group (wherein $Z_1$ represents a substituted or unsubstituted hydrocarbon group)

(IIa)

(IIb)

wherein $X_1$ has the same meaning as $X_0$; $Q_1$ represents an aliphatic group having from 1 to 18 carbon atoms or an aromatic group having from 6 to 12 carbon atoms; $b_1$ and $b_2$, which may be the same or different, each has the same meaning as $a_1$ and $a_2$; V represents —CN, $-CONH_2$, or wherein Y represents a hydrogen atom, a halogen atom, a hydrocarbon group, an alkoxyl group, or $-COOZ_2$, wherein $Z_2$ represents an alkyl group, an aralkyl group, or an aryl group (Abstract continued on next page.)

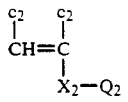

(III)

wherein $X_2$ has the same meaning as $X_0$ in formula (I); $Q_2$ has the same meaning as $Q_1$ in formula (IIa); and $c_1$ and $c_1$, which may be the same or different, have the same meaning as $a_1$ and $a_2$ in formula (I)

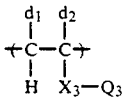

(IV)

wherein $X_3$ represents —COO—, —OCO—, —$CH_2$OCO—, —$CH_2$COO—, —O—, or —$SO_2$—; $Q_3$ represents a hydrocarbon group having from 1 to 22 carbon atoms; and $d_1$ and $d_2$, which may be the same or different, each represents a hydrogen atom, a halogen atom, a cyano group, a hydrocarbon group having from 1 to 8 carbon atoms, —COO—$Z_3$, or —COO—$Z_3$ bonded through a hydrocarbon group having from 1 to 8 carbon atoms, wherein $Z_3$ represents a hydrocarbon group having from 1 to 18 carbon atoms.

8 Claims, No Drawings

ELECTROPHOTOGRAPHIC LIGHT-SENSITIVE MATERIAL

FIELD OF THE INVENTION

This invention relates to an electrophotographic light-sensitive material, and more particularly to an electrophotographic light-sensitive material having excellent electrostatic characteristics, moisture resistance, and durability.

BACKGROUND OF THE INVENTION

An electrophotographic light-sensitive material may have various structures depending on the characteristics required or an electrophotographic process to be employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Further, a process of using an electrophotographic light-sensitive material as an offset master plate precursor for direct plate making is widely practiced.

Binders which are used for forming the photoconductive layer of an electrophotographic light-sensitive material are required to have film-forming properties by themselves and the capability if dispersing a photoconductive powder therein. Also, the photoconductive layer formed using the binder should have satisfactory adhesion to a base material or support. The photoconductive layer formed by using the binder also must have various electrostatic characteristics and image-forming properties, such that the photoconductive layer exhibits high charging capacity, small dark decay and large light decay, hardly undergoes fatigue before exposure, and maintains these characteristics in a stable manner against change of humidity at the time of image formation.

Binder resins which have been conventionally used include silicone resins (see JP-B-34-6670, the term "JP-B" as used herein means an "examined published Japanese patent application"), styrene-butadiene resins (see JP-B-35-1960), alkyd resins, maleic acid resins, and polyamide (see JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-11219, JP-B-36-8510, and JP-B-41-13946), etc. However, electrophotographic light-sensitive materials using these known resins have a number of disadvantages, i.e., poor affinity for a photoconductive powder (poor dispersion of a photoconductive coating composition); low photoconductive layer charging properties; poor reproduced image quality, particularly dot reproducibility or resolving power; susceptibility of the reproduced image quality to influences from the environment at the time of electrophotographic image formation, such as high temperature and high humidity conditions or low temperature and low humidity conditions; and insufficient film strength or adhesion of the photoconductive layer, which causes, when the light-sensitive material is used for an offset master, peeling of the photoconductive layer during offset printing thus failing to obtain a large number of prints; and the like.

To improve the electrostatic characteristics of a photoconductive layer, various approaches have hitherto been taken. For example, incorporation of a compound containing an aromatic ring or furan ring containing a carboxyl group or nitro group either alone or in combination with a dicarboxylic acid anhydride into a photoconductive layer has been proposed as disclosed in JP-B-42-6878 and JP-B-45-3073. However, the thus improved electrophotographic light-sensitive materials still have insufficient electrostatic characteristics, particularly light decay characteristics. The insufficient sensitivity of these light-sensitive materials has been compensated for by incorporating a large quantity of a sensitizing dye into the photoconductive layer. However, light-sensitive materials containing a large quantity of a sensitizing dye undergo considerable deterioration of whiteness to reduce the quality as a recording medium, sometimes causing a deterioration in dark decay characteristics, resulting in a failure to obtain a satisfactory reproduced image.

On the other hand, JP-A-60-10254 (the term "JP-A" as used herein means an "unexamined published Japanese patent application") suggests control of the average molecular weight of a resin to be used as a binder of the photoconductive layer. According to this suggestion, the combined use of an acrylic resin having an acid value of from 4 to 50 and an average molecular weight of from $1\times10^3$ to $1\times10^4$ and an acrylic resin having an acid value of from 4 to 50 and an average molecular weight of from $1\times10^4$ to $2\times10^5$ would improve the electrostatic characteristics (particularly reproducibility as a PPC light-sensitive material on repeated use), moisture resistance, and the like.

In the field of lithographic printing plate precursors, extensive studies have been conducted to provide binder resins for a photoconductive layer having electrostatic characteristics compatible with printing characteristics. Examples of binder resins so far reported to be effective for oil-desensitization of a photoconductive layer include a resin having a molecular weight of from $1.8\times10^4$ to $10\times10^4$ and a glass transition point of from 10° C. to 80° C. obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in JP-B-50-31011; a terpolymer containing a (meth)acrylic ester unit with a substituent having a carboxyl group at least 7 atoms distant from the ester linkage as disclosed in JP-A-53-54027; a tetra- or pentapolymer containing an acrylic acid unit and a hydroxyethyl (meth)acrylate unit as disclosed in JP-A-54-20735 and JP-A-57-202544; and a terpolymer containing a (meth)acrylic ester unit with an alkyl group having from 6 to 12 carbon atoms as a substituent and a vinyl monomer containing a carboxyl group as disclosed in JP-A-58-68046.

However, none of these resins proposed has proved to be satisfactory for practical use in charging properties, dark charge retention, photosensitivity, and surface smoothness of the photoconductive layer.

The binder resins proposed for use in electrophotographic lithographic printing plate precursors were also proved by actual evaluations to give rise to problems relating to electrostatic characteristics and background staining of prints.

In order to solve these problems, it has been proposed to use, as a binder resin, a low-molecular weight resin (molecular weight: $1\times10^3$ to $1\times10^4$) containing from 0.05 to 10% by weight of a copolymer component having an acid group in the side chain thereof to thereby improve surface smoothness and electrostatic characteristics of the photoconductive layer and t obtain background stain-free images as disclosed in JP-A-63-217354. It has also been proposed to use such a low-molecular weight resin in combination with a high-molecular weight resin (molecular weight: $1\times10^4$ or more) to thereby obtain sufficient film strength of the photoconductive layer to improve printing durability without impairing the above-described favorable characteristics as disclosed in Japanese Patent Application No. 63-49817 (JP-A-64-654), JP-A-63-220148 and JP-A-63-220149.

It has turned out, however, that use of these resins is still insufficient for stably maintaining performance properties in cases when the environmental conditions greatly change from high-temperature and high-humidity conditions to low-temperature and low-humidity conditions. In particular, in a scanning exposure system using a semi-conductor laser beam, the exposure time becomes longer and also there is a restriction on the exposure intensity as compared to a conventional overall simultaneous exposure system using a visible light and, hence, higher performance with respect to electrostatic characteristics, and particularly dark charge retention and photosensitivity has been demanded.

SUMMARY OF THE INVENTION

An object of this invention is to provide an electrophotographic light-sensitive material having stable and excellent electrostatic characteristics and providing clear images of high quality unaffected by variations in environmental conditions at the time of reproduction of an image, such as a change to low-temperature and low-humidity conditions or to high-temperature and high-humidity conditions.

Another object of this invention is to provide a CPC electrophotographic light-sensitive material having excellent electrostatic characteristics with small changes due to environmental changes.

A further object of this invention is to provide an electrophotographic light-sensitive material effective for a scanning exposure system using a semi-conductor laser beam.

A still further object of this invention is to provide an electrophotographic lithographic printing plate precursor having excellent electrostatic characteristics (particularly dark charge retention and photosensitivity), capable of providing a reproduced image having high fidelity to an original, causing neither overall background stains nor dotted background stains of prints, and having excellent printing durability.

It has now been found that the above objects of this invention are accomplished by an electrophotographic light-sensitive material comprising a support having thereon a photoconductive layer containing at least inorganic photoconductive particles and a binder resin, wherein the binder resin contains (A) at least one resin comprising a graft copolymer having a weight average molecular weight of from $1.0\times10^3$ to $2.0\times10^4$ and containing, as copolymer components, at least (i) a monofunctional macromonomer having a weight average molecular weight of not more than $2\times10^4$ and containing at least one polymer component represented by formula (IIa) or (IIb) shown below and at least one polymer component having at least one polar group selected from the group consisting of —COOH, $-PO_3H_2$, $-SO_3H$, —OH, and

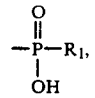

wherein $R_1$ represents a hydrocarbon group or $-OR_2$ (wherein $R_2$ represents a hydrocarbon group), with a polymerizable double bond group represented by formula (I) shown below being bonded to one terminal of the main chain thereof, and (ii) a monomer represented by formula (III) shown below, and (B) at least one resin having a weight average molecular weight of not less than $5\times10^4$, containing at least a recurring unit represented by formula (IV) shown below as a polymer component, and having a crosslinked structure.

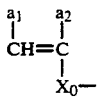

(I)

wherein $X_0$ represents —COO—, —OCO—, $-CH_2OCO-$, $-CH_2COO-$, —O—, $-SO_2-$, —CO—, —CONHCOO—, —CONHCONH—, $-CONHSO_2-$,

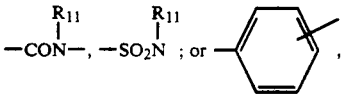

wherein $R_{11}$ represents a hydrogen atom or a hydrocarbon group; $a_1$ and $a_2$, which may be the same or different, each represents a hydrogen atom, a halogen atom, a cyano group, a hydrocarbon group, $-COO-Z_1$, or $-COO-Z_1$ bonded through a hydrocarbon group (wherein $Z_1$ represents a substituted or unsubstituted hydrocarbon group.

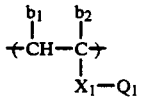

(IIa)

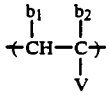

(IIb)

wherein $X_1$ has the same meaning as $X_0$; $Q_1$ represents an aliphatic group having from 1 to 18 carbon atoms or an aromatic group having from 6 to 12 carbon atoms; $b_1$ and $b_2$, which may be the same or different, each has the same meaning as $a_1$ and $a_2$; V represents —CN, $-CONH_2$, or

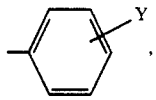

wherein Y represents a hydrogen atom, a halogen atom, a hydrocarbon group, an alkoxyl group, or —$COOZ_2$, wherein $Z_2$ represents an alkyl group, an aralkyl group, or an aryl group.

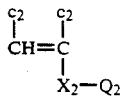

(III)

wherein $X_2$ has the same meaning as $X_0$ in formula (I); $Q_2$ has the same meaning as $Q_1$ in formula (IIa); and $c_1$ and $c_1$, which may be the same or different, have the same meaning as $a_1$ and $a_2$ in formula (I).

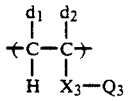

(IV)

wherein $X_3$ represents —COO—, —OCO—, —$CH_2OCO$—, —$CH_2COO$—, —O—, or —$SO_2$; $Q_3$ represents a hydrocarbon group having from 1 to 22 carbon atoms; and $d_1$ and $d_2$, which may be the same or different, each represents a hydrogen atom, a halogen atom, a cyano group, a hydrocarbon group having from 1 to 8 carbon atoms, —COO—$Z_3$, or —COO—$Z_3$ bonded through a hydrocarbon group having from 1 to 8 carbon atoms, wherein $Z_3$ represents a hydrocarbon group having from 1 to 18 carbon atoms.

That is, the binder resin which can be used in the present invention comprises at least a low-molecular weight graft copolymer containing, as copolymer components, (i) a monofunctional macromonomer (hereinafter referred to as macromonomer (M)) and (ii) a monomer represented by formula (III) (hereinafter referred to a resin (A)) and a high-molecular weight resin having a crosslinked structure at least in parts (hereinafter referred to as resin (B)).

In one embodiment of the present invention, resin (A) is a resin in which the graft copolymer has at least one polar group selected from the group consisting of —$PO_3H_2$, —$SO_3H$, —COOH, —OH, and

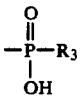

(wherein $R_3$ has the same meaning as $R_1$) at one terminal of the main chain thereof (hereinafter sometimes referred to as resin (A')).

In a preferred embodiment of the present invention, resin (B) is a resin having at least one polar group selected from the group consisting of —$PO_3H_2$, —$SO_3H$, —COOH, —OH, —SH,

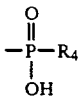

(wherein $R_4$ has the same meaning as $R_1$), a cyclic acid anhydride group-containing group, —CHO, —$CONH_2$, —$SO_2NH_2$, and

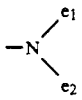

(wherein $e_1$ and $e_2$, which may be the same or different, each represents a hydrogen atom or a hydrocarbon group) at one terminal of at least one polymer main chain thereof (hereinafter sometimes referred to as resin (B')).

In another preferred embodiment of the present invention, resin (B) is a resin containing, as a polymer component, no recurring unit having the acidic group or cyclic acid anhydride-containing group as described with respect to resin (A).

DETAILED DESCRIPTION OF THE INVENTION

As described above, conventional acidic group-containing binder resins have been developed chiefly for use in offset master plates and, hence, have a high molecular weight (e.g., $5\times10^4$ or even more) so as to assure film strength sufficient for improving printing durability. Moreover, these known copolymers are random copolymers in which the acidic group-containing copolymer component is randomly present in the polymer main chain thereof.

To the contrary, resin (A) of the present invention is a graft copolymer, in which the acidic group or hydroxyl group (polar group) is not randomized in the main chain thereof but is bonded at specific position(s), i.e., in the grafted portion at random or, in addition, at the terminal of the main chain thereof.

Accordingly, it is assumed that the hydroxyl group or polar group moiety existing at a specific position apart from the main chain of the copolymer is adsorbed onto stoichiometric defects of inorganic photoconductive particles, while the main chain portion of the copolymer mildly and sufficiently cover the surface of the photoconductive particles. Thus, electron traps of the photoconductive particles can be compensated for and humidity resistance can be improved, while aiding sufficient dispersion of the photoconductive particles without agglomeration. Resin (B) serves to sufficiently increasing mechanical strength of the photoconductive layer which is insufficient in case of using resin (A) alone, without impairing the excellent electrophotographic characteristics obtained by using resin (A).

The photoconductive layer obtained by the present invention has improved surface smoothness. If a light-sensitive material to be used as a lithographic printing plate precursor is prepared from a non-uniform dispersion of photoconductive particles in a binder resin with agglomerates being present, the photoconductive layer has a rough surface. As a result, non-image areas cannot be rendered uniformly hydrophilic by oil-desensitization treatment with an oil-desensitizing solution. This being the case, the resulting printing plate induces adhesion of a printing ink to the non-image areas on printing, which phenomenon leads to background stains in the non-image areas of prints.

It was also confirmed that the resin binder of the present invention exhibits satisfactory photosensitivity as compared with random copolymer resins in which the acidic group-containing copolymer component is randomly present in the polymer main chain thereof.

Spectral sensitizing dyes which are usually used for imparting photosensitivity in the region of from visible light to infrared light exert their full spectral sensitizing action through adsorption on photoconductive particles. From this fact, it is believed that the binder resin containing the copolymer of the present invention properly interacts with photoconductive particles without hindering the adsorption of a spectral sensitizing dye on the photoconductive particles. This action of the binder resin is particularly pronounced in using cyanine dyes or phthalocyanine pigments which are particularly effective as spectral sensitizing dyes for sensitization in the region of from near infrared to infrared.

Resin (B) is a polymer having a moderately cross-linked structure, and resin (B') is a polymer containing a polar group at only one terminal of the main chain thereof. It is thus considered that an interaction among high molecular chains and, in addition, a weak interaction between the polar group and photoconductive particles exert synergistic effects to bring about markedly excellent performance properties in electrophotographic characteristics compatible with film strength.

On the other hand, if resin (B) contains a polymer component having the same polar group as that which may be bonded to the main chain terminal of resin (A), there is a tendency that dispersion of photoconductive particles is destroyed to form agglomerates or precipitates. If any coating film may be obtained from the dispersion, the resulting photoconductive layer would have seriously reduced electrostatic characteristics, or the photoconductive layer would have a rough surface and therefore suffers from deterioration of strength to mechanical abrasion.

When only the low-molecular weight resin (A) is used alone as a binder resin, it is sufficiently adsorbed onto photoconductive particles to cover the surface of the particles so that surface smoothness and electrostatic characteristics of the photoconductive layer can be improved and stain-free images can be obtained. Also, the film strength of the resulting light-sensitive material suffices for use as a CPC light-sensitive material or as an offset printing plate precursor for production of an offset printing plate to be used for obtaining around a thousand prints under limited printing conditions. However, a combined use of resin (B) achieves further improvement in mechanical film strength which may be still insufficient when in using resin (A) alone without impairing the functions of resin (A) at all. Therefore, the electrophotographic light-sensitive material according to the present invention has excellent electrostatic characteristics irrespective of variations in environmental conditions as well as sufficient film strength, thereby making it possible to provide an offset master plate having a printing durability amounting to 8000 or more prints even under severe printing conditions (such as under an increased printing pressure in using a large-sized printing machine).

In resin (A), the graft copolymer has a weight average molecular weight of from $1\times10^3$ to $2\times10^4$, and preferably from $3\times10^3$ to $1\times10^4$, and contains from 5 to 70 by weight, and preferably from 10 to 60% by weight, of the macromonomer unit. Where the copolymer contains a polar group at the terminal of the main chain thereof, the content of the polar group in the copolymer ranges from 0.5 to 15% by weight, and preferably from 1 to 10% by weight. Resin (A) preferably has a glass transition point of from −20° C. to 120° C., and preferably from −10° C. to 90° C.

If the molecular weight of resin (A) is less than $1\times10^3$, the film-forming properties of the binder are reduced, and sufficient film strength is not retained. On the other hand, if it exceeds $2\times10^4$, the electrophotographic characteristics, and particularly initial potential and dark decay retention, are degraded. Deterioration of electrophotographic characteristics is particularly conspicuous in using such a high-molecular weight polymer with a polar group content exceeding 3%, resulting in considerable background staining when used as an offset master.

If the content of the polar group in resin (A) (i.e., the polar group in the grafted portion and any arbitrary polar group at the terminal of the main chain) is less than 0.5% by weight, the initial potential is too low for a sufficient image density to be obtained. If it exceeds 15% by weight, dispersibility is reduced, film smoothness and humidity resistance are reduced, and background stains are increased when the light-sensitive material is used as an offset master.

The monofunctional macromonomer (M) which is a copolymer component of the graft copolymer resin, is described below. Macromonomer (M) is a compound having a weight average molecular weight of not more than $2\times10^4$ and containing at least one polymer component represented by formula (IIa) or (IIb) and at least one polymer component containing a specific polar group (—COOH, $—PO_3H_2$, $—SO_3H$, —OH, and/or

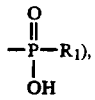

with a polymerizable double bond group represented by formula (I) being bonded to one terminal of the polymer main chain thereof.

In formulae (I), (IIa) and (IIb), hydrocarbon groups in $a_1$, $a_2$, $X_0$, $b_1$, $b_2$, $X_1$, $Q_1$ and V include substituted hydrocarbon groups and unsubstituted hydrocarbon groups, the number of carbon atoms previously recited being for the unsubstituted ones.

In formula (I), $X_0$ represents —COO—, —OCO—, $—CH_2OCO—$, $—CH_2COO—$, —O—, $—SO_2—$, —CO—, —CONHCOO—, —CONHCONH—, $—CONHSO_2—$,

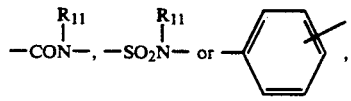

wherein $R_{11}$ represents a hydrogen atom or a hydrocarbon group. Specific examples of preferred hydrocarbon groups as $R_{11}$ are a substituted or unsubstituted alkyl group having from 1 to 18 carbon atoms (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), a substituted or unsubstituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), a substituted or unsubstituted alicyclic group having from 5 to 8 carbon atoms (e.g., cyclohexyl, 2-cyclohexylethyl, and 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

Where $X_0$ is

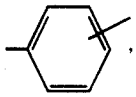

the benzene ring may be substituted with, for example, a halogen atom (e.g., chlorine and bromine), an alkyl group (e.g., methyl, ethyl, propyl, butyl, chloromethyl, and methoxymethyl), and an alkoxyl group (e.g., methoxy, ethoxy, propoxy, and butoxy).

$a_1$ and $a_2$, which may be the same or different, each preferably represents a hydrogen atom, a halogen atom (e.g., chlorine, bromine, and fluorine), a cyano group, an alkyl group having from 1 to 4 carbon atoms (e.g., methyl, ethyl, propyl, and butyl), $—COOZ_1$ or $—COOZ_1$ bonded via a hydrocarbon group (wherein $Z_1$ preferably represents a hydrogen atom, a substituted or unsubstituted alkyl group having from 1 to 18 carbon atoms, a substituted or unsubstituted alkenyl group, a substituted or unsubstituted aralkyl group, a substituted or unsubstituted alicyclic group, or a substituted or unsubstituted aryl group, specifically including those enumerated above with respect to $R_{11}$).

The hydrocarbon group in $—COO—Z_1$ bonded via a hydrocarbon group includes methylene, ethylene, and propylene groups.

More preferably, $X_0$ represents —COO—, —OCO—, $—CH_2COO—$, $—CH_2OCO—$, —O—, —CONHCOO—, —CONHCONH—, —CONH—, $—SO_2NH—$, or

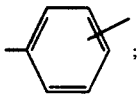

and $a_1$ and $a_2$, which may be the same or different, each represents a hydrogen atom, a methyl group, $—COOZ_1$, or $—CH_2COOZ_1$ ($Z_1$ more preferably represents a hydrogen atom or an alkyl group having from 1 to 6 carbon atoms (e.g., methyl, ethyl, propyl, butyl, and hexyl)).

Most preferably, either one of $a_1$ and $a_2$ is a hydrogen atom.

Specific examples of the polymerizable double bond group represented by formula (I) are:

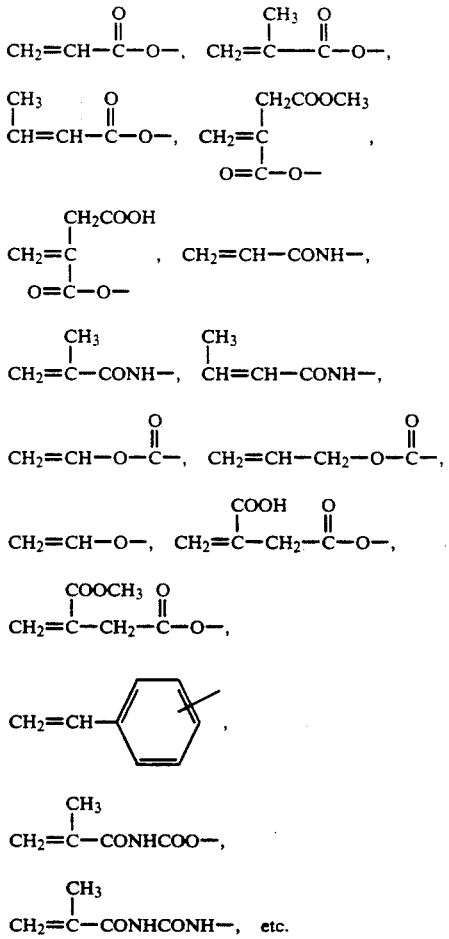

In formulae (IIa) and (IIb), $X_1$ has the same meaning as $X_0$ in formula (I). $b_1$ and $b_2$, which may be the same or different, have the same meaning as $a_1$ and $a_2$ in formula (I).

$Q_1$ represents an aliphatic group having from 1 to 18 carbon atoms or an aromatic group having from 6 to 12 carbon atoms. Examples of the aliphatic group include a substituted or unsubstituted alkyl group having from 1 to 18 carbon atoms (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl 2-(trimethoxysilyl)ethyl,2-tetrahydrofuryl, 2-thienylethyl, 2-N,N-dimethylaminoethyl, and 2-N,N-diethylaminoethyl), a cyanoalkyl group having from 5 to 8 carbon atoms (e.g., cycloheptyl, cyclohexyl, and cyclooctyl), and a substituted or unsubstituted aralkyl group having from 7 to 12 carbon atoms (e.g., benzyl, phenethyl, 3-phenylpropyl, naphthylmethyl 2-naphthylethyl, chlorobenzyl, bromobenzyl, dichlorobenzyl, methylbenzyl, chloromethylbenzyl, dimethylbenzyl, trimethylbenzyl, and methoxybenzyl). Examples of the aromatic group include a substituted or unsubstituted aryl group (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In formula (IIa), $X_1$ preferably represents —COO—, —OCO—, —$CH_2$COO—, —$CH_2$OCO—, —O—, —CO—, —CONHCOO—, —CONHCONH—, —CONH—, —$SO_2$NH— or

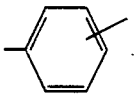

Preferred examples of $b_1$ and $b_2$ are the same as those described above for $a_1$ and $a_2$.

In formula (IIb), V represents —CN, —$CONH_2$, or

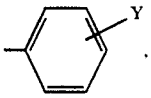

wherein Y represents a hydrogen atom, a halogen atom (e.g., chlorine and bromine), a hydrocarbon group (e.g., methyl, ethyl, propyl, butyl, chloromethyl, and phenyl), an alkoxyl group (e.g., methoxy, ethoxy, propoxy, and butoxy), or —$COOZ_2$ (wherein $Z_2$ preferably represents an alkyl group having from 1 to 8 carbon atoms, an aralkyl group having from 7 to 12 carbon atoms, or an aryl group).

Macromonomer (M) may contain two or more polymer components represented by formulae (IIa) and/or (IIb). Where $Q_1$ is an aliphatic group, it is preferable that the content of the aliphatic group having from 6 to 12 carbon atoms does not exceed 20% by weight based on the total polymer components in macromonomer (M).

Where $X_1$ in formula (IIa) is —COO—, it is preferable that the content of the polymer component of formula (IIa) is at least 30% by weight based on the total polymer components in macromonomer (M).

A component containing a specific polar group (—COOH, —$PO_3H_2$, —$SO_3$H, OH, and

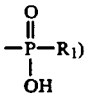

which is present in macromonomer (M) in addition to the copolymer component(s) of formulae (IIa) and/or (IIb) may be any of vinyl compounds containing such a polar group and copolymerizable with macromonomer (M). Examples of such vinyl compounds are described, e.g., in Kobunshi Gakkai (ed.), *Kobunshi Data Handbook* (*Kiso-hen*), Baifukan (1986). Specific examples of these vinyl monomers are acrylic acid, α- and/or β-substituted acrylic acids [e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds)], methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-methyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half ester derivatives of dicarboxylic acids, and ester or amide derivatives of these carboxylic acids or sulfonic acids containing the above-described polar group in the substituents thereof.

In the polar group

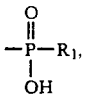

the hydrocarbon group as represented by $R_1$ or $R_2$ includes those described above for $Q_1$ in formula (IIa).

The polar group —OH includes alcohols containing a vinyl group or an allyl group (e.g., compounds containing —OH in the ester substituent or N-substituent thereof, e.g., allyl alcohol, methacrylic esters, and acrylamide), hydroxyphenol, and methacrylic acid esters or amides containing a hydroxyphenyl group as a substituent.

Specific examples of the polar group-containing vinyl monomers are shown below for illustrative purposes only but not for limitation. In the following formulae, a represents —H, —$CH_3$, —Cl, —Br, —CN, —$CH_2COOCH_3$, or —$CH_2$COOH; b represents —H or —$CH_3$; j represents an integer of from 2 to 18; k represents an integer of from 2 to 5; l represents an integer of from 1 to 4; and m represents an integer of from 1 to 12.

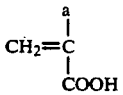

(A-1)

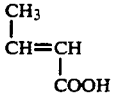

(A-2)

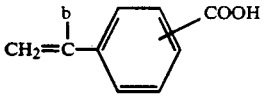

(A-3)

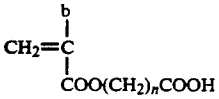

(A-4)

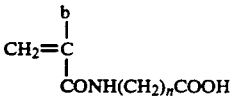

(A-5)

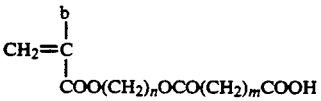

(A-6)

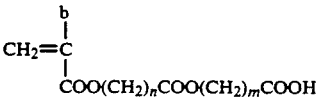

(A-7)

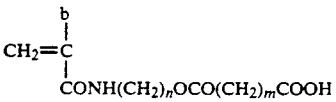

(A-8)

-continued
(A-9)
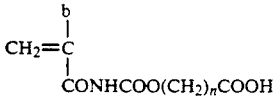
(A-10)
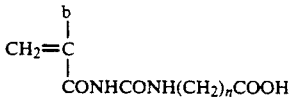
(A-11)
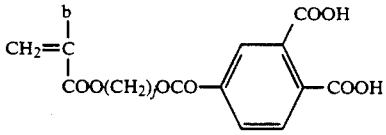
(A-12)
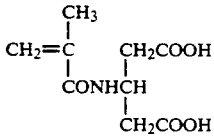
(A-13)
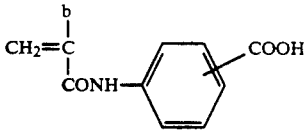
(A-14)
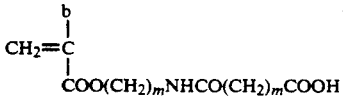
(A-15)
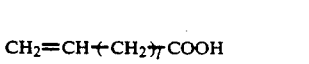
(A-16)
(A-17)
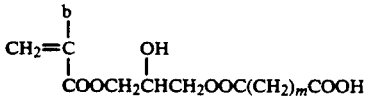
(A-18)
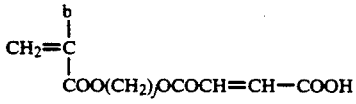
(A-19)
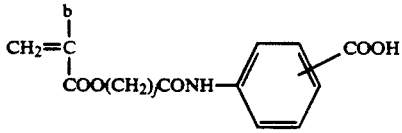
(A-20)
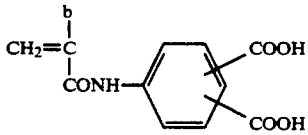
(A-21)
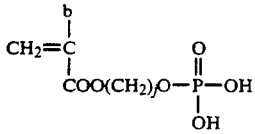
-continued
(A-22)
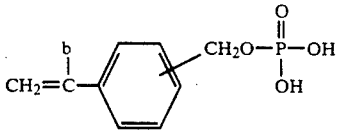
(A-23)
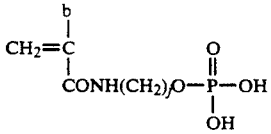
(A-24)
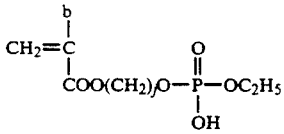
(A-25)
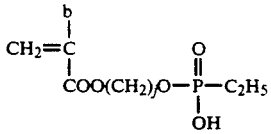
(A-26)
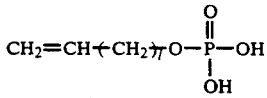
(A-27)
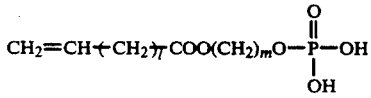
(A-28)
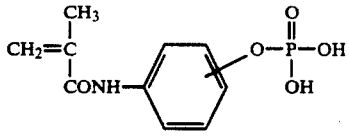
(A-29)
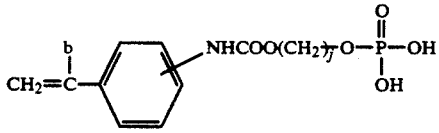
(A-30)
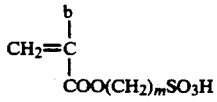
(A-31)
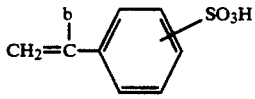
(A-32)
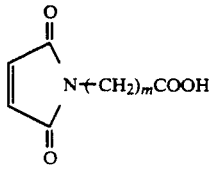

-continued (A-33)

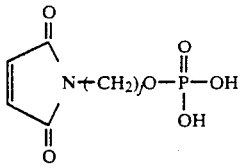

(A-34)

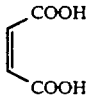

(A-35)

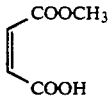

(A-36)

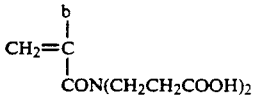

(A-37)

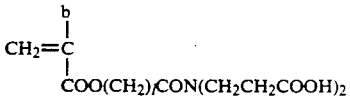

(A-38)

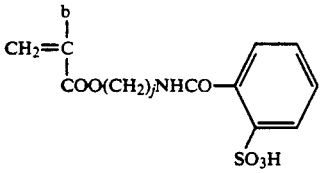

(A-39)

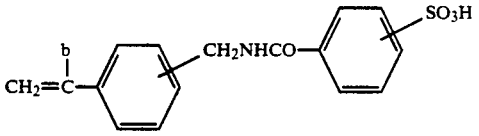

(A-40)

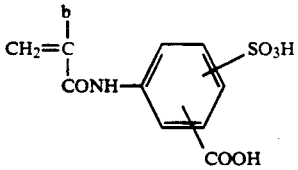

(A-41)

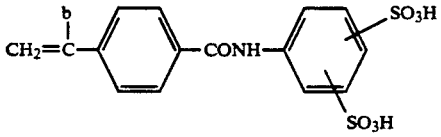

(A-42)

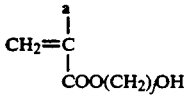

(A-43)

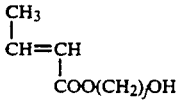

(A-44)

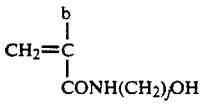

-continued (A-45)

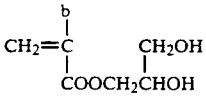

(A-46)

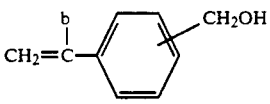

(A-47)

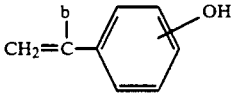

(A-48)

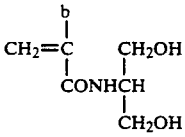

(A-49)

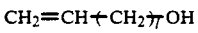

(A-50)

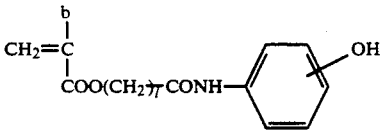

(A-51)

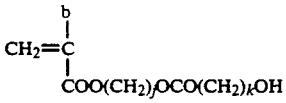

(A-52)

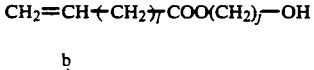

(A-53)

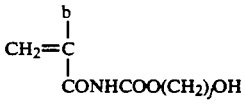

(A-54)

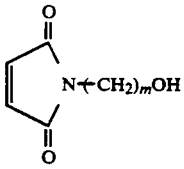

(A-55)

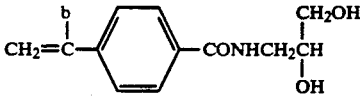

(A-56)

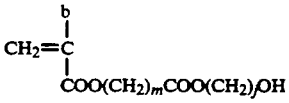

The proportion of the polar group-containing copolymer component in macromonomer (M) ranges from 0.5 to 50 parts by weight, and preferably from 1 to 40 parts by weight, per 100 parts by weight of the total polymer components.

When the monofunctional macromonomer comprising the polar group-containing random copolymer is copolymerized to obtain resin (A), a total content of the polar group-containing component present in the total grafted portion of resin (A) preferably ranges from 0.1 to 10 parts by weight per 100 parts by weight of the total polymer components in resin (A). In particular, where the polar group in the polar group-containing component is an acidic group selected from —COOH, —$SO_3H$, and —$PO_3H_2$, the total content of such component present in the grafted portion is preferably from 0.1 to 5% by weight.

Macromonomer (M) may further contain polymer components other than the above-mentioned polymer components. Examples of monomers corresponding to other recurring units include acrylonitrile, methacrylonitrile, acrylamides, methacrylamides, styrene and derivatives thereof (e.g., vinyltoluene, chlorostyrene, dichlorostyrene, bromostyrene, hydroxymethylstyrene, and N,N-dimethylaminomethylstyrene), and heterocyclic vinyl compounds (e.g., vinylpyrrolidone, vinylpyridine, vinylimidazole, vinylthiophene, vinylpyrazole, vinyldioxane, and vinyloxazine).

The proportion of these other recurring units in macromonomer (M) is preferably from 1 to 20 parts by weight per 100 parts by weight of the total polymer components.

As stated above, macromonomer (M) is a random copolymer comprising a recurring unit represented by formula (IIa) and/or (IIb) and a recurring unit containing a specific polar group and having a polymerizable double bond group represented by formula (I) bonded to only one terminal of the main chain thereof either directly or through an arbitrary linking group. Linking groups which connect the component of formula (I) to the compound of formula (IIa) or (IIb) or the polar group-containing component includes a carbon-carbon bond (single bond or double bond), a carbon-hetero atom bond (the hetero atom including an oxygen atom, a sulfur atom, a nitrogen atom, and a silicon atom), a hetero atom-hetero atom bond, and an arbitrary combination thereof. Specific examples of the linking group are

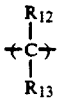

(wherein $R_{12}$ and $R_{13}$ each represents a hydrogen atom, a halogen atom (e.g., fluorine, chlorine, and bromine), a cyano group, a hydroxyl group, an alkyl group (e.g., methyl, ethyl, and propyl), etc.),

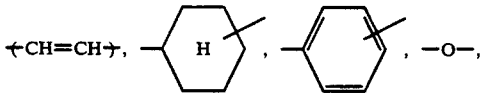

-continued

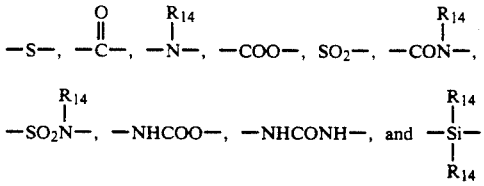

(wherein $R_{14}$ represents a hydrogen atom, a hydrocarbon group (the same as those enumerated for $Q_1$ in formula (IIa), etc.), and an arbitrary combination of two or more thereof.

If the weight average molecular weight of macromonomer (M) exceeds $2\times10^4$, copolymerizability with the monomer represented by formula (III) is reduced. If it is too small, the effect of improving electrophotographic characteristics of the photoconductive layer would be lessened and, accordingly, it is preferably not less than $1\times10^3$.

Macromonomer (M) can be easily produced by known processes for example, a radical polymerization process comprising radical polymerization in the presence of a polymerization initiator and/or a chain transfer agent containing a reactive group, e.g., a carboxyl group, an acid halide group, a hydroxyl group, an amino group, a halogen atom, and an epoxy group, in the molecule thereof to obtain an oligomer terminated with the reactive group and then reacting the oligomer with various reagents to prepare a macromonomer. For details, reference can be made to P. Dreyfuss & R. P. Quirk, *Encycl. Polym. Sci. Eng.*, Vol. 7, p. 551 (1987), P. F, Rempp and E. Franta, *Adv. Polym. Sci.*, Vol. 58, p. 1 (1984), Yushi Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, Koichi Itoh, *Kobunshi Kako*, Vol. 35, p. 262 (1986), Shiro Toki and Takashi Tsuda, *Kino Zairyo*, Vol. 1987, No. 10, p. 5, and literatures cited therein.

However, it should be taken into consideration that macromonomer (M) is produced using a polar group-containing compound as a polymer component. It is preferable, therefore, that synthesis of macromonomer (M) be carried out according to the following procedures.

Process (I)

Radical polymerization and introduction of a terminal reactive group are effected by using a monomer having a specific polar group in the form of a protected functional group. A typical mode of these reaction is shown by the following reaction scheme:

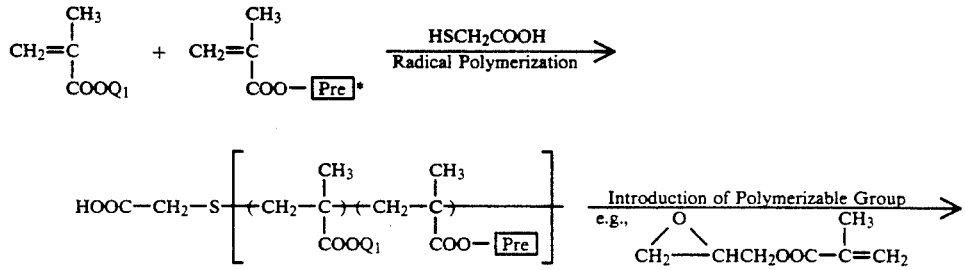

-continued

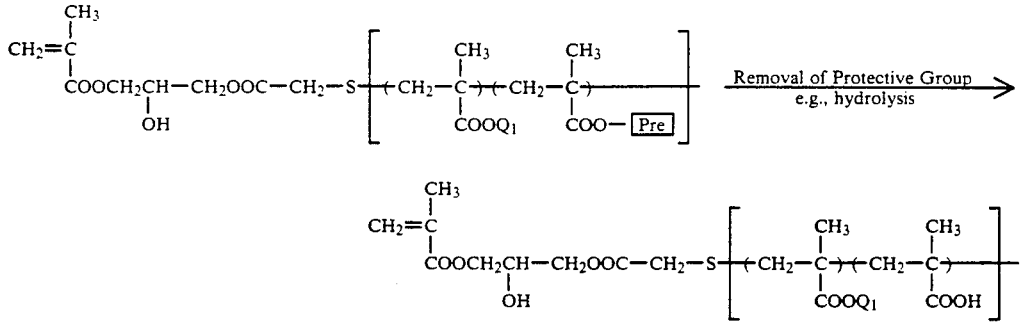

•Pre: Protective group for a carboxyl group, e.g., $-C(C_6H_5)_3$, $-Si(CH_3)_2-C_4H_7$, and 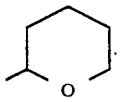 .

Protection of the polar group (i.e., $-SO_3H$, $-PO_3H_2$, —COOH,

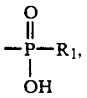

and —OH) randomly existing in macromonomer (M) and removal of the protective group (e.g., hydrolysis, hydrogenation, and oxidative decomposition) can be carried out according to known techniques. For details, reference can be made to J. F. W. MacOmie, *Protective Groups in Organic Chemistry,* Plenum Press (1973), T. W. Greene, *Protective Groups in Organic Synthesis,* John Wiley & Sons (1981), Ryohei Oda, *Kobunshi Fine Chemical,* Kodansha (1976), Yoshio Iwakura and Keisuke Kurita, *Han-nosei Kobunshi,* Kodansha (1977), G. Berner, et al., *J. Radiation Curing,* 1986, No. 10, p. 10, JP-A-62-212669, JP-A-62-286064, JP-A-62-210475, JP-A-62-195684, JP-A-62-258476, JP-A-63-260439, and Japanese Patent Application Nos. 62-220510 (JP-A-01-63977) and 62-226692 (JP-A-01-70767).

Process (II)

Process (II) comprises synthesizing an oligomer as described above, and reacting the oligomer terminated with a specific reactive group and also containing therein a polar group with a reagent containing a polymerizable double bond group which is selectively reactive with the specific reactive group by utilizing a difference in reactivity between said specific reactive group and said polar group. A typical mode of these reaction is illustrated by the following reaction scheme:

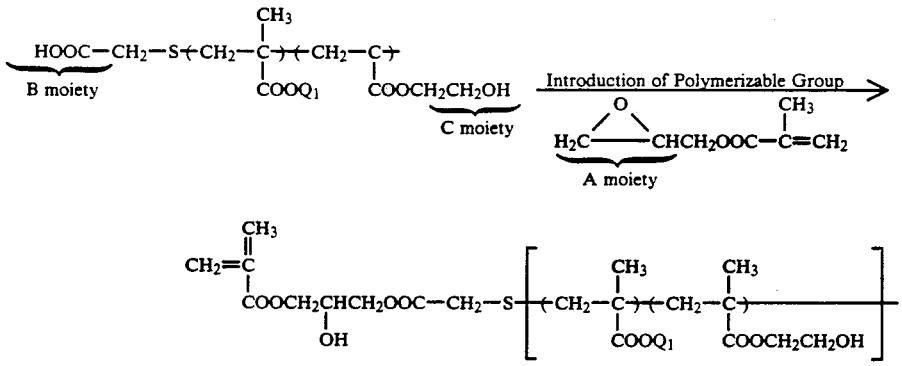

Specific examples of suitable combinations of specific functional groups shown by A, B, and C moieties in the above reaction scheme are shown in Table 1 below. It should be noted, however, that the present invention is not limited thereto. What is important in this reaction mode is that macromonomer synthesis be achieved without protecting the polar group by utilizing reaction selectivity generally observed in organic chemistry.

TABLE 1

| Functional Group in Reagent for Polymerizable Group Introduction (Moiety A) | Specific Functional Group Terminating Oligomer (Moiety B) | Polar Group in Recurring Unit Component of Oligomer (Moiety C) |
|---|---|---|
| 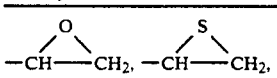 | —COOH<br>$-NH_2$ | —OH |

TABLE 1-continued

| Functional Group in Reagent for Polymerizable Group Introduction (Moiety A) | Specific Functional Group Terminating Oligomer (Moiety B) | Polar Group in Recurring Unit Component of Oligómer (Moiety C) |
|---|---|---|
| 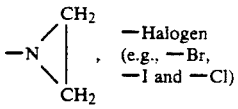 —Halogen (e.g., —Br, —I and —Cl) | | |
| —COCl, Acid anhydride, | —OH, | —COOH, $-SO_3H$, |
| $-SO_2Cl$ | $-NH_2$ | 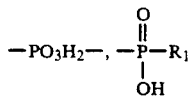 |
| —COOH, $-NHR_{15}$ ($R_{15}$: H or alkyl) | —Halogen $-PO_3H_2$, —OH, | —COOH, $-SO_3H$, |
| | | 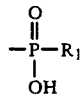 |
| —COOH, $-NHR_{15}$ | 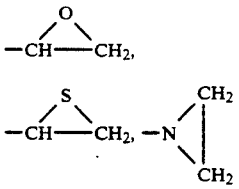 | —OH |
| —OH $-NHR_{15}$ | —COCl $-SO_2Cl$ | —COOH, $-SO_3H$, $-PO_3H_2$ |

Suitable chain transfer agents which can be used in the synthesis of macromonomer (M) include mercapto compounds containing a polar group or a substituent capable of being converted to a polar group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), or disulfide compounds (oxidation product of these mercapto compounds); and iodoalkyl compounds containing a polar group or a substituent capable of being converted to a polar group (e.g., iodoacetic acid, iodopropionic acid, 2-iodoethanol, 2-iodoethanesulfonic acid, and 3-iodopropanesulfonic acid). Preferred of them are mercapto compounds.

Examples of suitable polymerization initiators containing a specific reactive group which can be used in the synthesis of macromonomer (M) include 2,2'-azobis(2-cyanopropanol), 2,2'-azobis(2-cyanopentanol), 4,4'-azobis(4-cyanovaleric acid), 4,4'-azobis(4-cyanovaleryl chloride), 2,2'-azobis[2-(5-methyl-2-imidazolin-2-yl)propane], 2,2'-azobis[2-(2-imidazolin-2-yl)propane],2,2'-azobis[2-(3,4,5,6-tetrahydropyrimidin-2-yl)propane], 2,2'-azobis{2-[1-(2-hydroxyethyl)-2-imidazolin-2-yl]propane}, and 2,2'-azobis[2-methyl-N-(2-hydroxyethyl)propionamide].

The chain transfer agent or polymerization initiator is used in an amount of from 0.1 to 15 parts by weight, and preferably from 0.5 to 10 parts by weight, per 100 parts by weight of the total monomers.

Specific examples of macromonomer (M) are shown below for illustrative purposes only but not for limitation. In the following formulae, b represents —H or $-CH_3$; d represents —H, $-CH_3$, or $-CH_2COOCH_3$; R represents $-C_nH_{2n+1}$ (wherein n represents an integer of from 1 to 18), $-CH_2H_6H_5$,

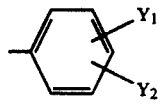

(wherein $Y_1$ and $Y_2$ each represents —H, —Cl, —Br, $-CH_3$, $-COCH_3$, or $-COOCH_3$),

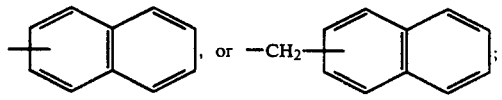

$W_1$ represents —CN, $-OCOCH_3$, $-CONH_2$, or $-C_6H_5$; $W_2$ represents —Cl, —Br, —CN, or $-OCH_3$; r represents an integer of from 2 to 18; s represents an integer of from 2 to 12; and t represents an integer of from 2 to 4.

(M-1)
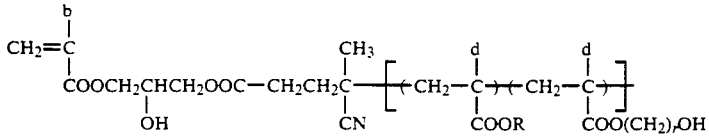
(M-2)
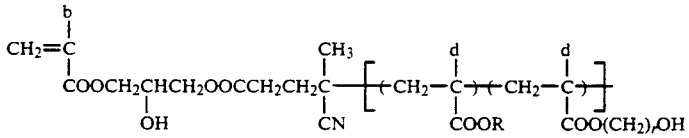
(M-3)
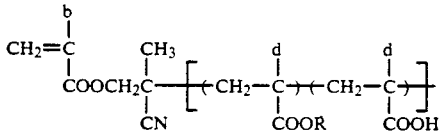
(M-4)
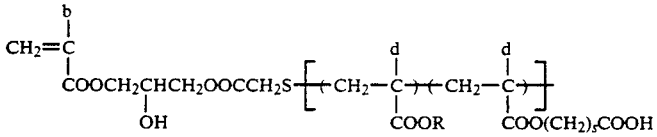
(M-5)
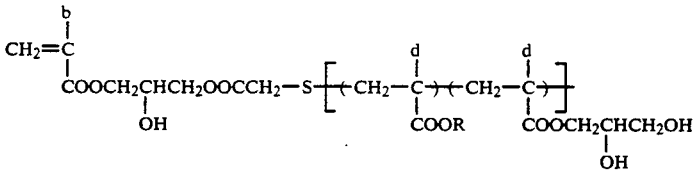
(M-6)
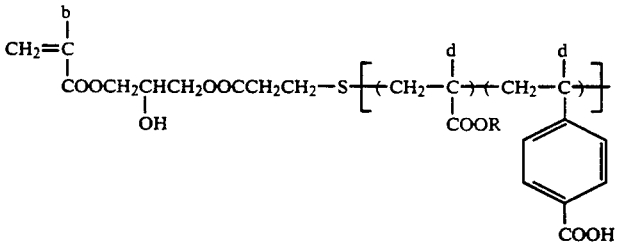
(M-7)
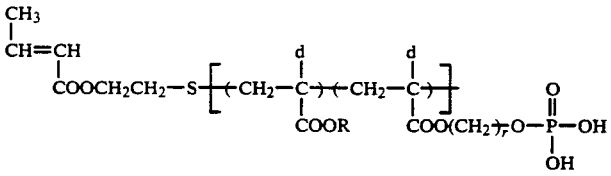
(M-8)
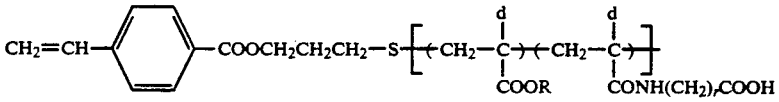
(M-9)
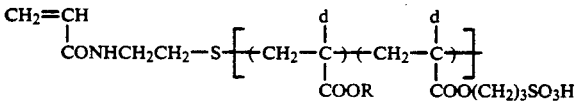
(M-10)
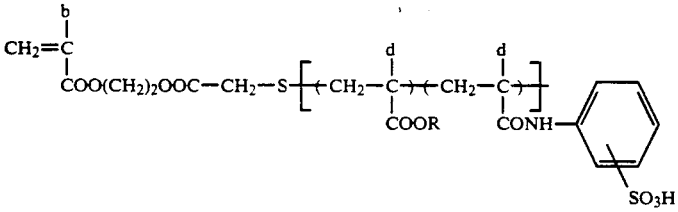

-continued
(M-11)
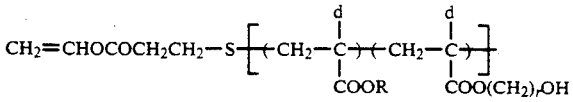
(M-12)
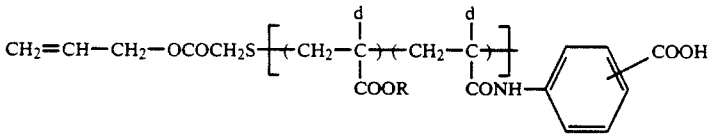
(M-13)
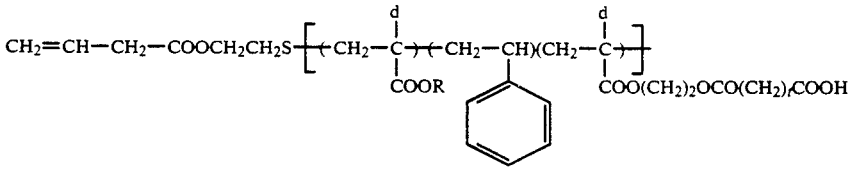
(M-14)
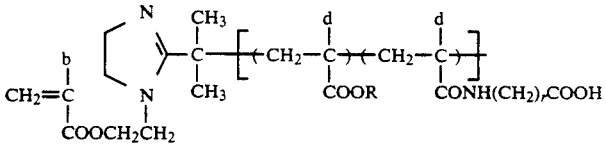
(M-15)
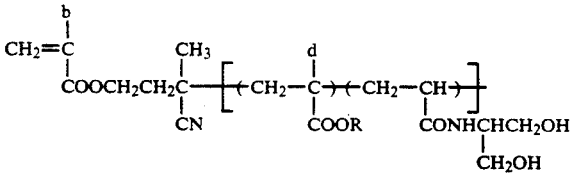
(M-16)
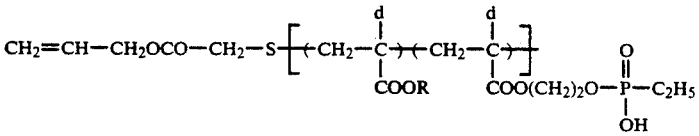
(M-17)
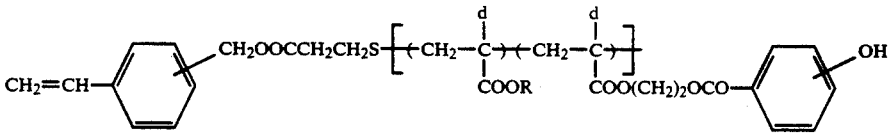
(M-18)
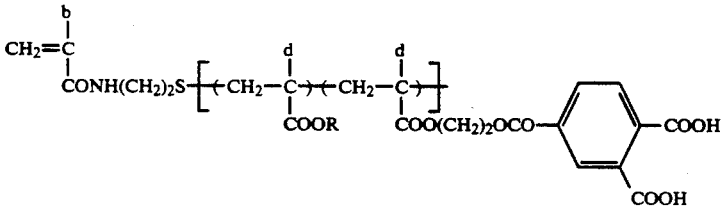
(M-19)
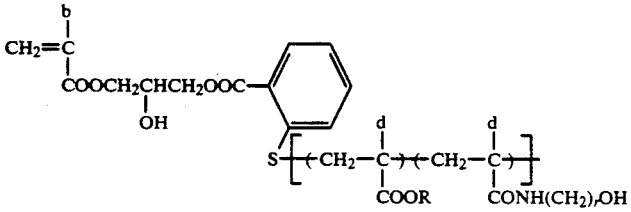
(M-20)
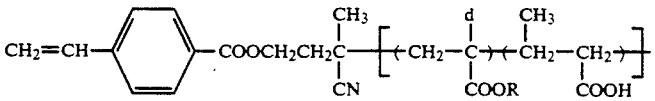

-continued

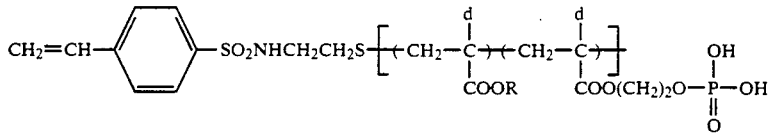

(M-21)

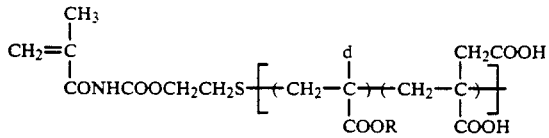

(M-22)

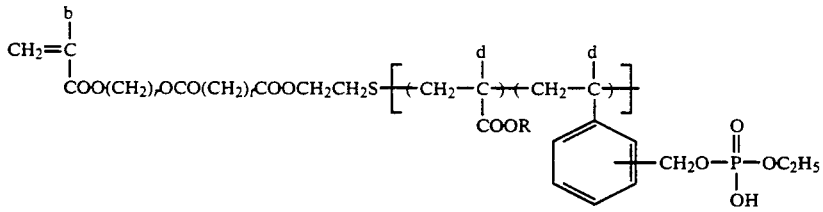

(M-23)

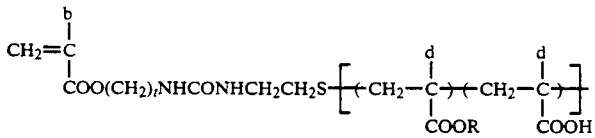

(M-24)

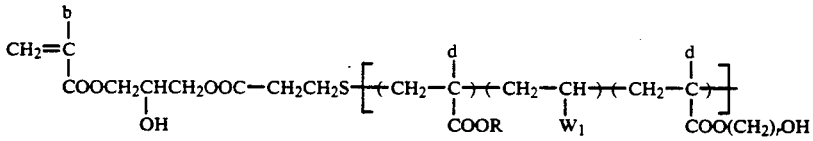

(M-25)

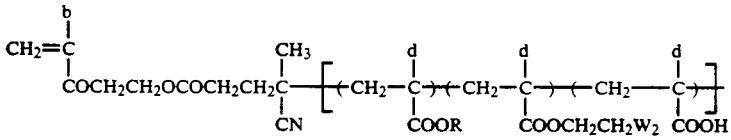

(M-26)

In the monomer of formula (III) which is copolymerized with macromonomer (M), $c_1$ and $c_2$, which may be the same or different, have the same meaning as $a_1$ and $a_2$ in formula (I); $X_2$ has the same meaning as $X_1$ in formula (IIa); and $Q_2$ has the same meaning as $Q_1$ in formula (IIa).

In resin (A), a weight ratio of the copolymer component corresponding to macromonomer (M) to the copolymer component corresponding to the monomer of formula (III) is preferably 5 to 70:95 to 30, and more preferably 10 to 60:90 to 40.

It is desirable for the polymer main chain in resin (A) to contain no copolymer component containing a polar group of $-PO_3H_2$, $-SO_3H$, $-COOH$, and

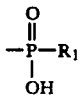

Resin (A) which can be used in the binder of the present invention may further contain other copolymer components in addition to macromonomer (M) and the monomer of formula (III). Examples of such other copolymer components include α-olefins, vinyl or allyl alkanoates, acrylonitrile, methacrylonitrile, vinyl ethers, acrylamides, methacrylamides, styrenes, and heterocyclic vinyl compounds (e.g., vinylpyrrolidone, vinylpyridine, vinylimidazole, vinylthiophene, vinylimidazoline, vinylpyrazole,vinyldioxane, vinylquinoline, vinylthiazole, and vinyloxazine).

The proportion of these monomers other than macromonomer (M) and the monomer of formula (III) in the copolymer should not exceed 20% by weight.

In the graft copolymer of resin (A), if the proportion of the copolymer component corresponding to macromonomer (M) is less than 5% by weight, dispersion of the coating composition for the photoconductive layer is insufficient. If it exceeds 70% by weight, copolymerization with the monomer of formula (III) does not proceed sufficiently, resulting in the formation of a homopolymer of the monomer of formula (III) or other monomer in addition to the desired graft copolymer. Besides, a dispersion of photoconductive particles in such a binder resin forms agglomerates of the photoconductive particles.

Resin (A) may contain a polar group selected from the group consisting of $-PO_3H_2$, $-SO_3H$, $-COOH$, $-OH$, and

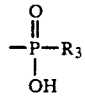

at one terminal of the polymer main chain comprising at least one macromonomer (M) and at least one monomer of formula (III) (i.e., resin (A')). Further, resin (A) having no such polar group and resin (A') having the polar group may be used in combination.

The polar groups, —OH and

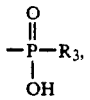

which may be bonded to one terminal of the polymer main chain have the same meaning as the polar groups, —OH and

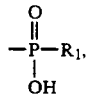

contained in the polar group-containing polymer component of resin (A). These polar groups may be bonded to one terminal of the polymer main chain either directly or via an arbitrary linking group.

The linking group includes a carbon-carbon bond (single bond or double bond), a carbon-hetero atom bond (the hetero atom including an oxygen atom, a sulfur atom, a nitrogen atom, and a silicon atom), a hetero atom-hetero atom bond, or an arbitrary combination thereof. Specific examples of the linking group are

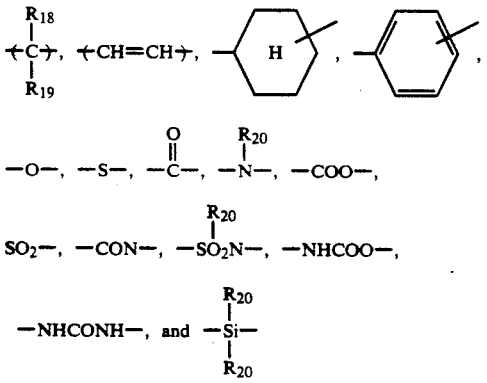

(wherein $R_{18}$, $R_{19}$, and $R_{20}$ have the same meaning as $R_{12}$, $R_{13}$, and $R_{14}$), and combinations of two or more thereof.

Resin (A') having a specific polar group at the terminal of the polymer main chain can be synthesized by a method in which at least macromonomer (M) and the monomer of formula (III) are copolymerized in the presence of a polymerization initiator or a chain transfer agent containing in the molecule thereof the specific polar group or a functional group capable of being converted to the polar group. More specifically, resin (A') can be synthesized according to the method described above for the synthesis of macromonomer (M) in which a reactive group-terminated oligomer is used.

The binder resin according to the present invention may contain two or more kinds of resin (A), inclusive of resin (A').

Resin (B) is a resin containing at least one recurring unit represented by formula (IV), having a partially crosslinked structure, and having a weight average molecular weight of $5\times10^4$ or more, and preferably from $8\times10^4$ to $6\times10^5$.

Resin (B) preferably has a glass transition point ranging from 0° C. to 120° C., and more preferably from 10° C. to 95° C.

If the weight average molecular weight of resin (B) is less than $5\times10^4$, the effect of improving film strength is insufficient. If it exceeds the above-recited preferred upper limit, on the other hand, resin (B) has no substantial solubility in organic solvents and thus cannot be practically used.

Resin (B) is a polymer satisfying the above-mentioned physical properties with a part thereof being crosslinked, including a homopolymer comprising the recurring unit shown by formula (IV) or a copolymer comprising the recurring unit of formula (IV) and other monomer copolymerizable with the monomer corresponding to the recurring unit of formula (IV).

In formula (IV), hydrocarbon groups may have a substituent.

$X_3$ preferably represents —COO—, —OCO—, —$CH_2$OCO—, —$CH_2$COO—, or —O—, and more preferably —COO—, —$CH_2$COO—, or —O—.

$Q_3$ preferably represents a substituted or unsubstituted hydrocarbon group having from 1 to 18 carbon atoms. The substituent may be any of substituents other than the aforesaid polar groups which may be bonded to the one terminal of the polymer main chain. Examples of such substituents include a halogen atom (e.g., fluorine, chlorine, and bromine), —O—$V_1$, —COO—$V_2$, and —OCO—$V_3$, wherein $V_1$, $V_2$, and $V_3$ each represents an alkyl group having from 6 to 22 carbon atoms (e.g., hexyl, octyl, decyl, dodecyl, hexadecyl, and octadecyl). Specific examples of preferred hydrocarbon groups as $Q_3$ are a substituted or unsubstituted alkyl group having from 1 to 18 carbon atoms (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), a substituted or unsubstituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), a substituted or unsubstituted alicyclic group having from 5 to 8 carbon atoms (e.g., cyclohexyl, 2-cyclohexylethyl, and 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

$d_1$ and $d_2$, which may be the same or different, each preferably represents a hydrogen atom, a halogen atom (e.g., fluorine, chlorine, and bromine), a cyano group, an alkyl group having from 1 to 3 carbon atoms, —COO—$Z_3$, or —$CH_2$COO—$Z_3$, wherein $Z_3$ preferably represents an aliphatic group having from 1 to 22 carbon atoms. More preferably, $d_1$ and $d_2$, which may be the same or different, each represents a hydrogen atom, an alkyl group having from 1 to 3 carbon atoms, —COO—$Z_3$, or —$CH_2COO$—$Z_3$ ($Z_3$ more preferably represents an alkyl group having from 1 to 18 carbon atoms or an alkenyl group, e.g., methyl, ethyl, and propyl, butyl, hexyl, octyl, decyl, dodecyl, tridecyl, tetradecyl, hexadecyl, octadecyl, pentenyl, hexenyl, octenyl, and decenyl). These alkyl or alkenyl groups may be substituted with the same substituent(s]as enumerated with respect to $Q_3$.

In the production of resin (B), introduction of a crosslinked structure in the polymer can be achieved by known techniques, for example, a method of conducting polymerization of the monomer of formula (IV) in the presence of a polyfunctional monomer and a method of introducing a crosslinking functional group into a polymer and conducting a crosslinking reaction by a high polymer reaction.

From the standpoint of ease and convenience of procedure, that is, considered that there are involved no unfavorable problems such that a long time is required for the reaction, the reaction is not quantitative, or impurities arising from a reaction accelerator, etc. are incorporated into the product, it is preferable to synthesize resin (B) by using a self-crosslinkable functional group: —$CONHCH_2OR_{21}$ (wherein $R_{21}$ represents a hydrogen atom or an alkyl group) or by utilizing crosslinking through polymerization.

Where a polymerizable reactive group is used, it is preferable to copolymerize a monomer containing two or more polymerizable functional groups and the monomer of formula (IV) to thereby form a crosslinked structure over polymer chains.

Specific examples of suitable polymerizable functional groups are $CH_2$=CH—, $CH_2$=CH—$CH_2$—,

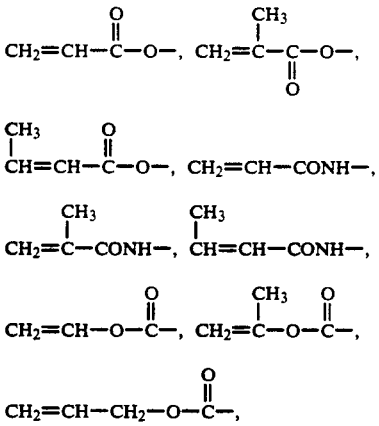

$CH_2$=CH—NHCO—, $CH_2$=CH—$CH_2$—NHCO—, $CH_2$=CH—$SO_2$—, $CH_2$=CH—CO—, $CH_2$=CH—O—, and $CH_2$=CHS—. The two or more polymerizable functional groups in the monomer may be the same or different.

Specific examples of the monomer having two or more same polymerizable functional groups include styrene derivatives (e.g., divinylbenzene and trivinylbenzene); esters of a polyhydric alcohol (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or a polyhydroxyphenol (e.g., hydroquinone, resorcin, catechol, and derivatives thereof) and methacrylic acid, acrylic acid or crotonic acid; vinyl esters, allyl esters, vinylamides or allylamides of a dibasic acid (e.g., malonic acid, succinic acid, glutaric acid, adipic acid, pimelic acid, maleic acid, phthalic acid, and itaconic acid); and condensates of a polyamine (e.g., ethylenediamine, 1,3-propylenediamine, and 1,4-butylenediamine) and a carboxylic acid having a vinyl group (e.g., methacrylic acid, acrylic acid, crotonic acid, and allylacetic acid).

Specific examples of the monomer having two or more different polymerizable functional groups include vinyl-containing ester derivatives or amide derivatives of a vinyl-containing carboxylic acid (e.g., methacrylic acid, acrylic acid, methacryloylacetic acid, acyrloylacetic acid, methacryloylpropionic acid, acryloylpropionic acid, itaconyloylacetic acid, itaconyloylpropionic acid, and a reaction product of a carboxylic acid anhydride and an alcohol or an amine (e.g., allyloxycarbonylpropionic acid, allyloxycarbonylacetic acid, 2-allyloxycarbonylbenzoic acid, and allylaminocarbonylpropionic acid)) (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconic acid amide, and methacryloylpropionic acid allylamide) and condensates of an amino alcohol (e.g., aminoethanol, 1-aminopropanol, 1-aminobutanol, 1-aminohexanol, and 2-aminobutanol) and a vinyl-containing carboxylic acid.

Resin (B) having a partially crosslinked structure can be obtained by polymerization using the above-described monomer having two or more polymerizable functional groups in a proportion of not more than 20% by weight based on the total monomers. It is more preferable for the monomer having two or more polymerizable functional groups to be used in a proportion of not more than 15% by weight in cases where a polar group is introduced into the terminal by using a chain transfer agent hereinafter described, or in a proportion of not more than 5% by weight in other cases.

On the other hand, where resin (B) contains no polar group at the terminal thereof (i.e., resin (B) other than resin (B')), a crosslinked structure may be formed in resin (B) by using a resin containing a crosslinking functional group which undergoes curing on application of heat and/or light.

Such a crosslinking functional group may be any of those capable of undergoing a chemical reaction between molecules to form a chemical bond. That is, a mode of reaction inducing intermolecular bonding by condensation, addition reaction, etc. or crosslinking, etc. by polymerization upon application of heat and/or light can be made use.

Examples of the above-described crosslinking functional group include (i) at least one combination of (i-1) a functional group having a dissociative hydrogen atom (e.g., —COOH, —$PO_3H_2$,

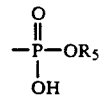

(wherein $R_5$ represents an alkyl group having from 1 to 18 carbon atoms, preferably an alkyl group having from 1 to 6 carbon atoms (e.g., methyl, ethyl, propyl, butyl, and hexyl), an aralkyl group having from 7 to 11 carbon atoms (e.g., benzyl, phenethyl, methylbenzyl, chlorobenzyl, and methoxybenzyl), an aryl group having from 6 to 12 carbon atoms (e.g., phenyl, tolyl, xylyl, mesitylene, chlorophenyl, ethylphenyl, methoxyphenyl, and naphthyl), —$OR_{22}$ (wherein $R_{22}$ is the same as the above-mentioned hydrocarbon group for $R_{21}$), —OH, —SH, and —NH—$R_{23}$ (wherein $R_{23}$ represents a hydrogen atom or an alkyl group having from 1 to 4 carbon atoms, e.g., methyl, ethyl, propyl, and butyl)) and (i-2) a functional group selected from the group consisting of

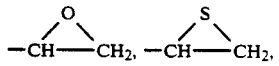

—NCO, and —NCS; and (ii) a group containing —$CONHCH_2OR_{24}$ (wherein $R_{24}$ represents a hydrogen atom or an alkyl group having from 1 to 6 carbon atoms, e.g., methyl, ethyl, propyl, butyl, and hexyl) or a polymerizable double bond group.

Specific examples of the polymerizable double bond group are the same as those enumerated above for the polymerizable functional groups.

More specific examples of the functional groups and compounds to be used are described are described, e.g., in Tsuyoshi Endo, *Netsukokasei Kobunshi no Seimitsuka,* C.M.C K.K. (1986), Yuji Harada, *Saishin Binder Gijutsu Binran,* Ch. II-1, Sogo Gijutsu Center (1985), Takayuki Ohtsu, *Acryl Jushi no Gosei Sekkei to Shin Yoto Kaihatsu,* Chubu Keiei Kaihatsu Center Shuppanbu (1985), Eizo Ohmori, *Kinosei Acryl Jushi,* Techno System (1985), Hideo Inui and Gentaro Nagamatsu, *Kankosei Kobunshi,* Kodansha (1977), Takahiro Kadota, *Shin Kankosei Jushi,* Insatsu Gakkai Shuppanbu (1981), G. E. Green and B. P. Star R, *J. Macro. Sci. Revs. Macro. Chem.,* C21(2), pp. 187–273 (1981–1982), and C. G. Roffey, *Photopolymerization of Surface Coatings,* A. Wiley Interscience Pub. (1982).

These crosslinking functional groups may be present in the same copolymer component or separately in different copolymer components.

The monomer corresponding to the copolymer component containing the crosslinking functional group includes vinyl compounds containing such a functional group and capable of copolymerizable with the monomer of formula (IV). Examples of such vinyl compounds are described, e.g., in Kobunshi Gakkai (ed.), *Kobunshi Data Handbook* [*Kiso-hen*], Baifukan (1986). Specific examples of these vinyl monomers are acrylic acid, α- and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds)), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-methyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half ester derivatives of dicarboxylic acids, and ester or amide derivatives of these carboxylic acids or sulfonic acids containing the above-described polar group in the substituents thereof.

The proportion of the above-described copolymer component containing the crosslinking functional group in resin (B) preferably ranges from 1 to 80 by weight, and more preferably from 5 to 50% by weight.

In the preparation of such a resin, a reaction accelerator may be used, if desired, to accelerate crosslinking. Examples of usable reaction accelerators include acids (e.g., acetic acid, propionic acid, acetic acid, benzenesulfonic acid, and p-toluenesulfonic acid), peroxides, azobis compounds, crosslinking agents, sensitizing agents, and photopolymerizable monomers. Specific examples of crosslinking agents are described in Shinzo Yamashita and Tosuke Kaneko (ed.), *Kakyozai Handbook,* Taiseisha (1981), including commonly employed crosslinking agents, such as organosilanes, polyurethanes, and polyisocyanates, and curing agents, such as epoxy resins and melamine resins.

Where the resin contains a light-crosslinking functional group, compounds described in the literature cited above with respect to photosensitive resins can be used.

Resin (B) may further contain, as copolymer component, other monomers [e.g., those enumerated above as optional monomers which may be present in resin (A)], in addition to the monomer corresponding to the recurring unit of formula (IV) and the above-described polyfunctional monomer.

While resin (B) is characterized by its partial crosslinked structure as stated above, it is also required to be soluble in an organic solvent used for the preparation of a dispersion for forming a photoconductive layer. More specifically, it is required that at least 5 parts by weight of resin (B) be dissolved in 100 parts by weight of toluene at 25° C. Solvents which can be used in the preparation of the dispersion include halogenated hydrocarbons, e.g., dichloromethane, dichloroethane, chloroform, methylchloroform, and triclene; alcohols, e.g., methanol, ethanol, propanol, and butanol; ketones, e.g., acetone, methyl ethyl ketone, and cyclohexanone; ethers, e.g., tetrahydrofuran and dioxane; esters, e.g., methyl acetate, ethyl acetate, propyl acetate, butyl acetate, and methyl propionate; glycol ethers, e.g., ethylene glycol monomethyl ether, 2-methoxyethylacetate; and aromatic hydrocarbons, e.g., benzene, toluene, xylene, and chlorobenzene. These solvents may be used either individually or as a mixture thereof.

According to a preferred embodiment of resin (B), resin (B') is a polymer having a weight average molecular weight of $5\times10^4$ or more, and preferably between $8\times10^4$ and $6\times10^5$, containing at least one recurring unit represented by formula (IV), having a partially crosslinked structure and, in addition, having at least one polar group selected from the group consisting of —$PO_3H_2$, —$SO_3H$, —COOH, —OH (specifically including those enumerated with respect to resin (A)), —SH,

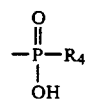

(wherein $R_4$ has the same meaning as $R_1$), a cyclic acid anhydride-containing group, —CHO, —$CONH_2$, —$SO_2NH_2$, and

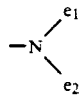

(wherein $e_1$ and $e_2$, which may be the same or different, each represents a hydrogen atom or a hydrocarbon group) bonded to one terminal of at least one main chain thereof.

Resin (B') preferably has a glass transition point of from 0° C. to 120° C., and more preferably from about 10° C. to 95° C.

The cyclic acid anhydride-containing group which is present in resin (B') is a group containing at least one cyclic acid anhydride moiety. The cyclic acid anhydride which is present includes aliphatic dicarboxylic acid anhydrides and aromatic dicarboxylic acid anhydrides.

Specific examples of aliphatic dicarboxylic acid anhydride rings include a succinic anhydride ring, a glutaconic anhydride ring, a maleic anhydride ring, a cyclopentane-1,2-dicarboxylic acid anhydride ring, a cyclohexane-1,2-dicarboxylic acid anhydride ring, a cyclohexane-1,2-dicarboxylic acid anhydride ring, and a 2,3-bicylo[2,2,2]octanedicarboxylic acid anhydride ring. These rings may have a substituent, such as a halogen atom (e.g., chlorine and bromine) and an alkyl group (e.g., methyl, ethyl, butyl, and hexyl).

Specific examples of aromatic dicarboxylic acid rings include a phthalic anhydride ring, a naphthalene-dicarboxylic acid anhydride ring, a pyridine-dicarboxylic acid anhydride ring, and a thiophene-dicarboxylic acid anhydride ring. These rings may have a substituent, such as a haolgen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

In the polar group

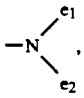

specific examples of $e_1$ and $e_2$ are a hydrogen atom, a substituted or unsubstituted aliphatic group having from 1 to 10 carbon atoms (e.g., methyl, ethyl, propyl, butyl, hexyl, octyl, 2-cyanoethyl, 2-chloroethyl, 2-ethoxycarbonylethyl, benzyl, phenethyl, and chlorobenzyl), and a substituted or unsubstituted aryl group (e.g., phenyl, tolyl, xylyl, chlorophenyl, bromophenyl, methoxycarbonylphenyl, and cyanophenyl).

Of the terminal polar groups in resin (B'), preferred are $-PO_3H_2$, $-COOH$, $-SO_3H$, $-OH$, $-SH$

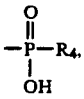

$-CONH_2$, and $-SO_2NH_2$.

In resin (B') the specific polar group is bonded to one terminal of the polymer main chain either directly or via an arbitrary linking group. The linking group includes a carbon-carbon bond (single bond or double bond), a carbon-hetero atom bond (the hetero atom including an oxygen atom, a sulfur atom, a nitrogen atom, and a silicon atom), a hetero atom-hetero atom bond, or an arbitrary combination thereof. Specific examples of the linking group are

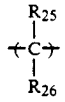

(wherein $R_{25}$ and $R_{26}$ each represents a hydrogen atom, a halogen atom (e.g., fluorine, chlorine, and bromine), a cyano group, a hydroxyl group, an alkyl group (e.g., methyl, ethyl, and propyl), etc.),

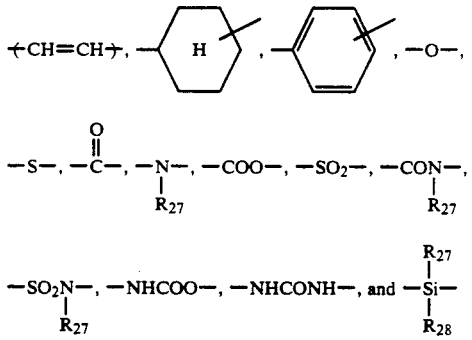

(wherein $R_{27}$ and $R_{28}$ each represents a hydrogen atom, a hydrocarbon group having from 1 to 8 carbon atoms (e.g., methyl, ethyl, propyl, butyl, pentyl, hexyl, benzyl, phenethyl, phenyl, and tolyl) or $-OR_{29}$ (wherein $R_{29}$ has the same meaning as the hydrocarbon group of $R_{27}$)).

Resin (B') having a specific polar group bonded to only one terminal of at least one polymer main chain thereof can be easily synthesized by a method comprising reacting various reagents on the terminal of a living polymer obtained by conventional anion polymerization or cation polymerization (ion polymerization method), a method comprising radical polymerization using a polymerization initiator and/or chain transfer agent containing a specific polar group in the molecule (radical polymerization method), or a method comprising once preparing a polymer terminated with a reactive group by the aforesaid ion polymerization method or radical polymerization method and converting the terminal reactive group into a specific polar group by a high polymer reaction. For the detail, reference can be made to P. Dryfuss and R. P. Quirk *Encycl. Polym. Sci. Eng.*, Vol. 7, p. 551 (1987), Yoshiki Nakajo and Yuya Yamashita, *Senryo to Yakuhin*, Vol. 30, p. 232 (1985), and Akira Ueda and Susumum Nagai, *Kagaku to Kogyo*, Vol. 60, p. 57 (1986), and literatures cited therein.

In greater detail, resin (B') can be prepared by a method in which a mixture of the recurring unit shown by formula (IV), the above-described polyfunctional monomer for forming a crosslinked structure, and a chain transfer agent containing a specific polar group to be introduced to one terminal is polymerized in the presence of a polymerization initiator (e.g., azobis compounds and peroxides), a method using a polymerization initiator containing a specific polar group to be introduced without using the aforesaid chain transfer agent, or a method using a chain transfer agent and a polymerization initiator both of which contain a specific polar group to be introduced. Further, resin (B') may also be obtained by conducting polymerization using a compound having a functional group, such as an amino group, a halogen atom, an epoxy resin, an acid halide group, etc., as the chain transfer agent or polymerization initiator according to any of the three methods set forth above, followed by reacting such a functional group through a high polymer reaction to thereby introduce the polar group.

Suitable chain transfer agents include mercapto compounds containing a polar group or a substituent capable of being converted to a polar group (e.g., thioglycolic acid, thiomalic acid, thiosalicyclic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]-propionic acid, 3-[N-mercaptoethyl)amino]propionic N-(3-mercaptopropyionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol), or disulfide compounds (oxidation product of these mercapto compounds); and iodoalkyl compounds containing a polar group or a substituent capable of being converted to a polar group (e.g., iodoacetic acid, iodopropionic acid, 2-iodoethanol, 2-iodoethanesulfonic acid, and 3-iodopropanesulfonic acid). Preferred of them are mercapto compounds.

The chain transfer agent or polymerization initiator is used in an amount of from 0.5 to 15 parts by weight, and preferably from 1 to 10 parts by weight, per 100 parts by weight of the total monomers.

The binder resin of the present invention may further comprise, in addition to resins (A) [inclusive of resin (A')] and (B) [inclusive of resin (B')], other known resins, such as alkyd resins, polybutyral resins, polyolefins, ethylene-vinyl acetate copolymers, styrene resins, styrene-butadiene resins, acrylate-butadiene resins, and vinyl alkanoate resins, in a proportion up to 30% by weight based on the total binder resin. If the proportion of these other resins exceed 30% by weight, the effects of the present invention, particularly on improvement of electrostatic characteristics, are lost.

The ratio of resin (A) to resin (B) varies depending on the kind, particle size, and surface conditions of the inorganic photoconductive particles used. In general, the weight ratio of resin (A) to resin (B) is 5 to 80:95 to 20, and preferably 15 to 60:85 to 40.

The inorganic photoconductive material which can be used in the present invention includes zinc oxide, titanium oxide, zinc sulfide, cadmium sulfide, cadmium carbonate, zinc selenide, cadmium selenide, tellurium selenide, and lead sulfide, with zinc oxide and titanium oxide being preferred.

The binder resin is used in a total amount of from 10 to 100 parts by weight, and preferably from 15 to 50 parts by weight, per 100 parts by weight of the inorganic photoconductive material.

If desired, the photoconductive layer according to the present invention may contain various spectral sensitizers. Examples of suitable spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), phthalocyanine dyes (inclusive of metallized dyes), and the like as described in Harumi Miyamoto and Hidehiko Takei, *Imaging*, Vol. 1973, No. 8, p. 12, C. J. Young, et al., *RCA Review*, Vol. 15, p. 469 (1954), Kohei Kiyota, et al., *Journal of Electric Communication Society of Jacan, J63-C*, No. 2, p. 97 (1980), Yuji Harasaki, et al., *Kogyo Kagaku Zasshi*, Vol. 66, pp. 78 and 188 (1963), and Tadaaki Tani, *Journal of the Society of Photographic Science and Technology of Japan*, Vol. 35, p. 208 (1972).

Specific examples of suitable carbonium dyes, triphenylmethane dyes, xanthene dyes, and phthalein dyes are described in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Suitable polymethine dyes, such as oxonol dyes, merocyanine dyes, cyanine dyes, and rhodacyanine dyes, include those described in F. M. Harmmer, *The Cyanine Dyes and Related Compounds*. Specific examples are described in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

In addition, polymethine dyes for spectral sensitization in the longer wavelength region of 700 nm or more, i.e., from the near infrared region to the infrared region, include those described in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, 216, pp. 117–118 (1982).

The light-sensitive material of the present invention is also superior, in that the performance properties tend not to vary even when combined with various kinds of sensitizing dyes.

If desired, the photoconductive layer may further contain various additives commonly employed in an electrophotographic photoconductive layer, such as chemical sensitizers. Examples of such additives include electron-accepting compounds (e.g., halogen, benzoquinone, chloranil, acid anhydrides, and organic carboxylic acids) described in *Imaging*, Vol. 1973, No. 8, p. 12 supra; and polyarylalkane compounds, hindered phenol compounds, and p-phenylenediamine compounds described in Hiroshi Komon, et al., *Saikin-no Kododen Zairyo to Kankotai no Kaihatsu Jitsuyoka*, Chs. 4–6, Nippon Kagaku Joho K.K. (1986).

The amount of these additives is not particularly critical and usually ranges from 0.0001 to 2.0 parts by weight per 100 parts by weight of the photoconductive particles.

The photoconductive layer of the light-sensitive material suitably has a thickness of from 1 to 100 μm, particularly from 10 to 50 μm.

Where the photoconductive layer functions as a charge generating layer in a laminated light-sensitive material comprising a charge generating layer and a charge transport layer, the thickness of the charge generating layer suitably ranges from 0.01 to 1 μm, particularly from 0.05 to 0.5 μm.

Charge transporting materials useful in the above-described laminated type light-sensitive material include polyvinylcarbazole, oxazole dyes, pyrazoline dyes, and triphenylmethane dyes. The thickness of the charge transport layer ranges from 5 to 40 μm, and preferably from 10 to μm.

Resins which can be used in an insulating layer or the charge transport layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be formed on any known support. In general, a support for an electrophotographic light-sensitive material is preferably electrically conductive. Any of conventionally employed conductive supports may be utilized in this invention. Examples of usable conductive supports include a base, e.g., a metal sheet, paper, and a synthetic resin sheet, having been rendered electrically conductive by, for example, impregnation with a low resistant substance; the above-described base with the back side thereof (opposite to the photoconductive layer) being rendered conductive and having further coated thereon at least one layer for the purpose of prevention of curling; the above-described supports having thereon a water-resistant adhesive layer; the above-described supports having thereon at least one precoat layer; and paper laminated with a synthetic resin film on which aluminum, etc. is deposited.

Specific examples of conductive supports and materials for imparting conductivity are described in Yukio Sakamoto, *Denshishashin,* Vol. 14, No. 1, pp. 2-11 (1975), Hiroyuki Moriga, *Nyumon Tokushushi no Kagaku,* Kobunshi Kankokai (1975), and M. F. Hoover, *J. Macromol. Sci. Chem.,* A-4(6), pp. 1327-1417 (1970).

The present invention will now be illustrated in greater detail by way of Synthesis Examples, Examples, and Comparative Examples, but it should be understood that the present invention is not deemed to be limited thereto. Unless otherwise indicated herein, all parts, percents, ratios and the like are by weight.

SYNTHESIS EXAMPLE 1 OF MACROMONOMER

Synthesis of Macromonomer MM-1

A mixture of 90 g of ethyl methacrylate, 10 g of 2-hydroxyethyl methacrylate, 5 g of thioglycolic acid, and 200 g of toluene was heated to 75° C. with stirring in a nitrogen stream. To the mixture was added 1.0 g of 2,2'-azobisisobutyronitrile (hereinafter abbreviated as AIBN) to conduct a reaction for 8 hours. To the mixture were added 8 g of glycidyl methacrylate, 1.0 g of N,N-dimethyldodecylamine, and 0.5 g of t-butylhydroquinone, followed by stirring at 100° C. for 12 hours. After cooling, the reaction solution was reprecipitated in 2 l of n-hexane to obtain 82 g of macromonomer (MM-1) having an average molecular weight of $3.8\times10^3$ as a white powder.

(MM-1):

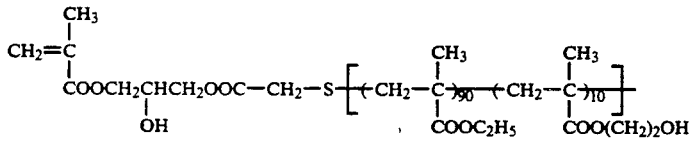

SYNTHESIS EXAMPLE 2 OF MACROMONOMER (M)

Synthesis of Macromonomer (MM-2)

A mixture of 90 g of butyl methacrylate, 10 g of methacrylic acid, 4 g of 2-mercaptoethanol, and 200 g of tetrahydrofuran was heated to 70° C. in a nitrogen stream. To the mixture was added 1.2 g of AIBN to conduct a reaction for 8 hours.

After cooling in a water bath to 20° C., 10.2 g of triethylamine was added to the reaction mixture, and then 14.5 g of methacryl chloride was added dropwise thereto at a temperature of 25° C. or less with stirring. After the addition, the stirring was further continued for 1 hour. Thereafter, 0.5 g of t-butylhydroquinone was added to the reaction mixture, and the mixture was stirred for 4 hours at a temperature elevated to 60° C. After cooling, the reaction mixture was added dropwise in 1 of water over a period of about 10 minutes, followed by stirring for 1 hour. After allowing the mixture to stand, the aqueous phase was removed by decantation. The solid thus collected was washed with water twice, dissolved in 100 ml of tetrahydrofuran, and then reprecipitated in 2 l of petroleum ether. The precipitate thus formed was collected by decantation and dried under reduced pressure to obtain 65 g of macromonomer (MM-2) having a weight average molecular weight of $5.6\times10^3$ as a viscous substance.

(MM-2):

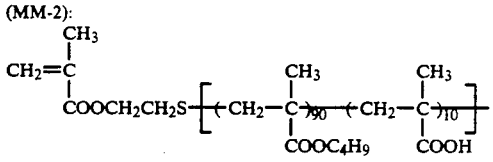

SYNTHESIS EXAMPLE 3 OF MACROMONOMER

Synthesis of Macromonomer MM-3

A mixture of 95 g of benzyl methacrylate, 5 g of 2-phosphonoethyl methacrylate, 4 g of 2-aminoethylmercaptan, and 200 g of tetrahydrofuran was heated to 70° C. with stirring in a nitrogen stream.

To the mixture was added 1.5 g of AIBN to conduct a reaction for 5 hours. Then, 0.5 g of AIBN was further added thereto, followed by reacting for 4 hours. The reaction mixture was cooled to 20° C., and 10 g of acrylic anhydride was added thereto, followed by stirring at 20° to 25° C. for 1 hour. Then, 1.0 g of t-butylhydroquinone was added thereto, followed by stirring at 50° to 60° C. for 4 hours. After cooling, the reaction mixture was added dropwise to 1 l of water while stirring over a period of about 10 minutes. After the stirring was further continued for an additional period of 1 hour, the aqueous phase was removed by decantation. Washing with water was further repeated twice more. The solid was dissolved in 100 ml of tetrahydrofuran, and the solution was re-precipitated in 2 l of petroleum ether. The precipitate was collected by decantation and dried under reduced pressure to obtain 70 g of macromonomer MM-3 having a weight average molecular weight of $7.4\times10^3$ as a viscous substance.

(MM-3):

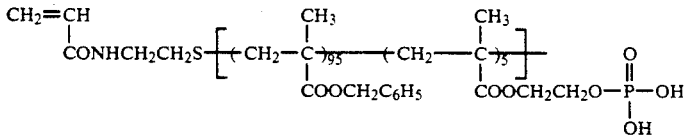

SYNTHESIS EXAMPLE 4 OF MACROMONOMER

Synthesis of Macromonomer MM-4

A mixture of 90 g of 2-chlorophenyl methacrylate, 10 g of monomer (A) shown below, 4 g of thioglycolic acid, and 200 g of tetrahydrofuran was heated to 70° C. in a nitrogen stream. To the mixture was added 1.5 g of AIBN to conduct a reaction for 5 hours. Then, 0.5 g of AIBN was further added thereto, followed by reacting for 4 hours. To the reaction mixture were added 12.4 g of glycidyl methacrylate, 1.0 g of N,N-dimethyldodecylamine, and 1.5 g of t-butylhydroquinone, and the mixture was allowed to react at 110° C. for 8 hours. After cooling, the reaction mixture was added to 100 ml of a 90 vol % tetrahydrofuran aqueous solution containing 3 g of p-toluenesulfonic acid, followed by stirring at 30° to 35° C. for 1 hours. The mixture was precipitated in 2 l of a mixed solvent of water/ethanol (⅓ by volume), and the precipitate was collected by decantation. The precipitate was dissolved in 200 ml of tetrahydrofuran, and the solution was reprecipitated in 2 l of n-hexane to obtain 58 g of macromonomer MM-4 having a weight average molecular weight of $7.6\times10^3$ as a powder.

SYNTHESIS EXAMPLE 5 OF MACROMONOMER

Synthesis of Macromonomer MM-5

A mixture of 95 of 2,6-dichlorophenyl methacrylate, 5 g of 3-(2'-nitrobenzyloxysulfonyl)propyl methacrylate, 150 g of toluene, and 50 g of isopropyl alcohol was heated to 80° C. in a nitrogen stream. To the mixture was added 5.0 g of 2,2'-azobis(2-cyanovaleric acid) (hereinafter abbreviated as ACV) to conduct a reaction for 5 hours, and then, 1.0 g of ACV was added thereto, followed by reaction for 4 hours. After cooling, the reaction mixture was precipitated in 2 l of methanol, and the powder precipitated was collected by filtration and dried under reduced pressure.

A mixture of 50 g of the powder, 14 g of glycidyl methacrylate, 0.6 g of N,N-dimethyldodecylamine, 1.0 g of t-butylhydroquinone, and 100 g of toluene was stirred at 110° C. for 10 hours. After cooling to room temperature, the mixture was irradiated with light emitted from a high-pressure mercury lamp (80 W) for 1 hour under stirring. The reaction mixture was precipitated in 1 of methanol, and the powder thus precipitated Monomer (A):

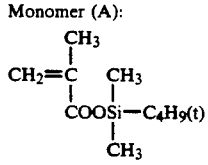

(MM-4):

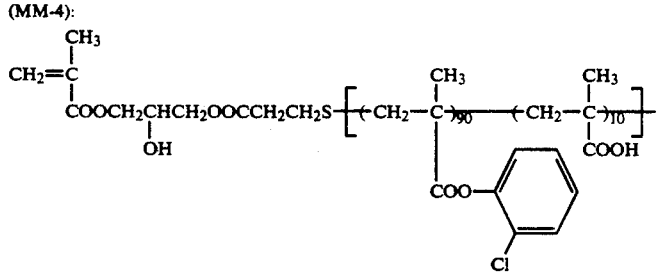

was collected by filtration and dried under reduced pressure to obtain 34 g of macromonomer MM-5 having a weight average molecular weight of $7.3\times10^3$.

(MM-5):

-continued

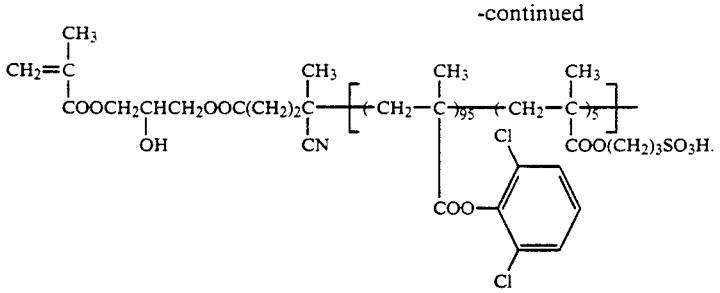

SYNTHESIS EXAMPLE 1 OF RESIN (A)

Synthesis of Resin A-1

A mixture of 75 g of phenyl methacrylate, 25 g of MM-2 obtained in Synthesis Example 2 of Macromonomer, and 100 g of toluene was heated to 100° C. in a nitrogen stream. To the mixture was added 6 g of AIBN to conduct a reaction for 4 hours, and 3 g of AIBN was further added thereto to conduct a reaction for 3 hours to obtain a copolymer (A-4) having a weight average molecular weight of $8.6\times10^3$.

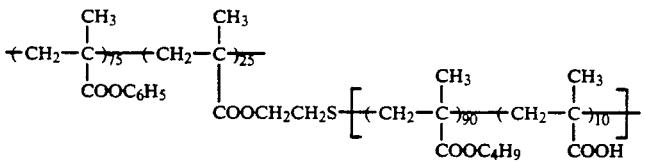

SYNTHESIS EXAMPLE 2 OF RESIN (A)

Synthesis of Resin A-2

A mixture of 70 g of 2-chlorophenyl methacrylate, 30 g of MM-1 prepared in Synthesis Example 1 of Macromonomer, 3.0 g of β-mercaptopropionic acid, and 150 g of toluene was heated to 80° C. in a nitrogen stream. To the mixture was added 1.0 g of AIBN to conduct a reaction for 4 hours. To the mixture was further added 0.5 g of AIBN to conduct a reaction for 2 hours, and then 0.3 g of AIBN was furthermore added thereto, followed by reacting for 3 hours to obtain a copolymer (A-2) having a weight average molecular weight of $8.5\times10^3$.

(A-2):

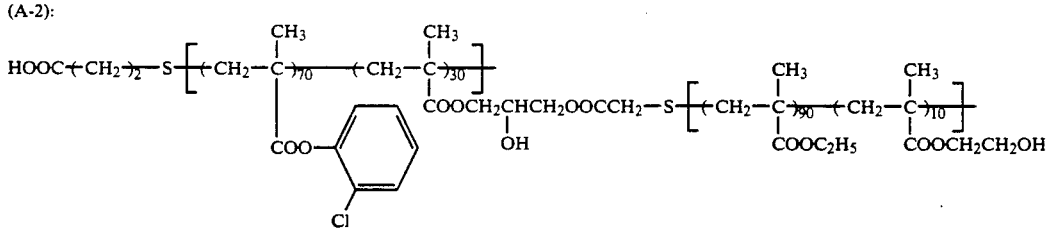

SYNTHESIS EXAMPLE 3 OF RESIN (A)

Synthesis of Resin A-3

A mixture of 60 g of 2-chloro-6-methylphenyl methacrylate, 25 g of MM-4 prepared in Synthesis Example 4 of Macromonomer, 15 g of methyl acrylate, 100 g of toluene, and 50 g of isopropyl alcohol was heated to 80° C. in a nitrogen stream. To the mixture was added 5.0 g of ACV, followed by reacting for 5 hours. To the mixture was further added 1 g of ACV, followed by reacting for 4 hours to obtain a copolymer (A-3) having a weight average molecular weight of $8.5\times10^3$.

(A-3):

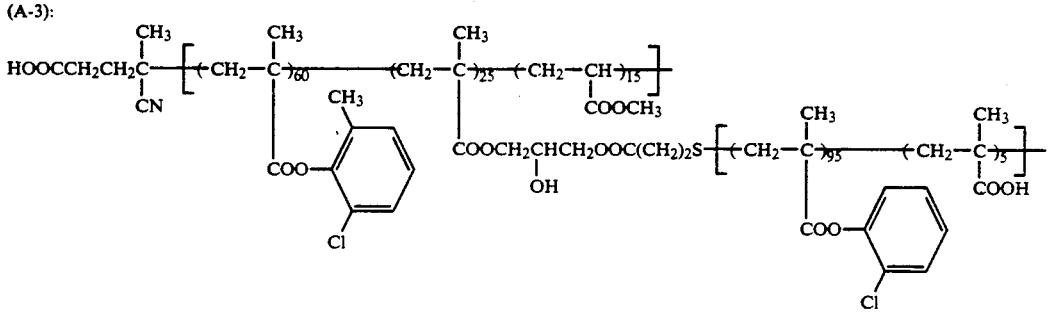

SYNTHESIS EXAMPLES 4 TO 13 OF RESIN (A)

Synthesis of Resins A-4 to A-13

Resins (A) shown in Table 2 below were prepared in the same manner as in Synthesis Example 1 of Resin (A). The resulting resins had a weight average molecular weight of from $6.0\times10^3$ to $9\times10^3$.

TABLE 2

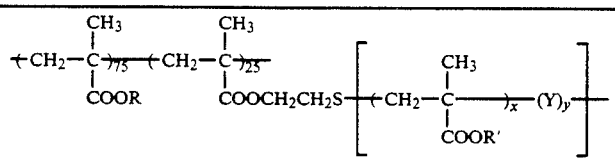

| Synthesis Example No. | Resin (A) | R | R' | x/y (by weight) | —Y— |
|---|---|---|---|---|---|
| 4 | A-4 | $-C_2H_5$ | 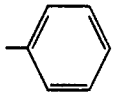 | 90/10 | $-CH_2-CH(COOH)-$ |
| 5 | A-5 | $-C_3H_7$ | 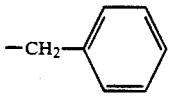 | 85/15 | $-CH_2-C(CH_3)(COO(CH_2)_2OCO(CH_2)_3COOH)-$ |
| 6 | A-6 | $-C_4H_9$ | 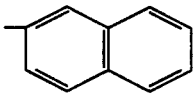 | 90/10 | $-CH_2-C(CH_3)(COO(CH_2)_2O-P(=O)(OH)-OH)-$ |
| 7 | A-7 | 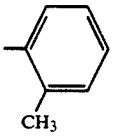 | $-CH_3$ | 90/10 | $-CH_2-CH(COOCH_2CH_2COOH)-$ |
| 8 | A-8 | 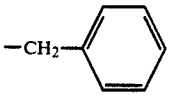 | $-C_2H_5$ | 90/10 | 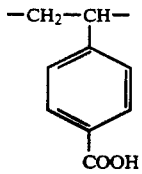 |
| 9 | A-9 | 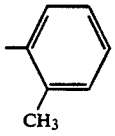 | $-C_4H_9$ | 92/8 | $-CH_2-C(CH_3)(COO(CH_2)_3SO_3H)-$ |
| 10 | A-10 | $-CH_3$ | 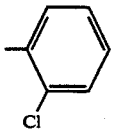 | 93/7 | $-CH_2-C(COOH)(CH_2COOH)-$ |
| 11 | A-11 | $-CH_3$ | $-C_2H_5$ | 90/10 | $-CH_2-C(CH_3)(COO(CH_2)_2-P(=O)(OH)-OCH_3)-$ |
| 12 | A-12 | 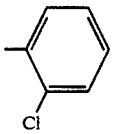 | $-C_2H_5$ | 95/5 | $-CH_2-C(CH_3)(COOH)-$ |

TABLE 2-continued

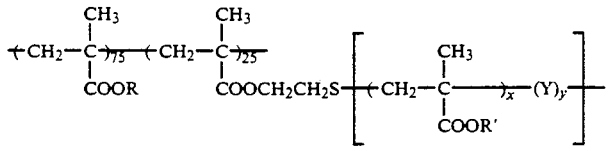

| Synthesis Example No. | Resin (A) | R | R' | x/y (by weight) | —Y— |
|---|---|---|---|---|---|
| 13 | A-13 | 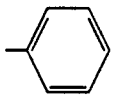 | 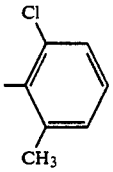 | 90/10 | 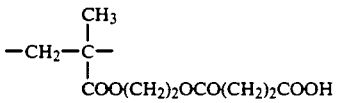 |

SYNTHESIS EXAMPLES 14 TO 27 OF RESIN (A)

Synthesis of Resins A-14 to A-27

Resins (A) shown in Table 3 below were prepared in the same manner as in Synthesis Example 2 of Resin (A). The resulting resins (A) had a weight average molecular weight (Mw) of from $5.0\times10^3$ to $9\times10^3$.

TABLE 3

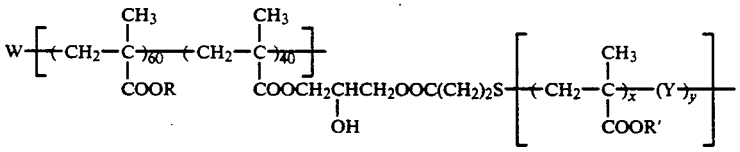

| Resin (A) | W— | R | R' | x/y (by weight) | —Y— |
|---|---|---|---|---|---|
| A-14 | HOOC—$H_2C$—S— | 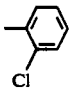 | —$C_2H_5$ | 90/10 | 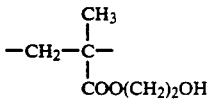 |
| A-15 | 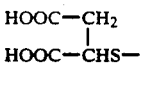 | 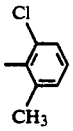 | 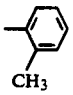 | 85/15 | 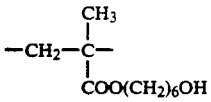 |
| A-16 | 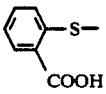 | 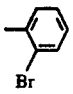 | 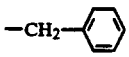 | 90/10 | 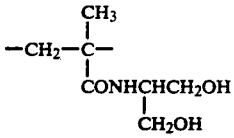 |
| A-17 | 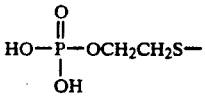 | —$C_2H_5$ | 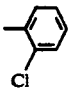 | 92/8 | 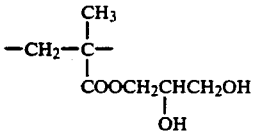 |
| A-18 | $HO_3SCH_2CH_2S$— | 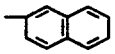 | —$C_4H_9$ | 93/7 | 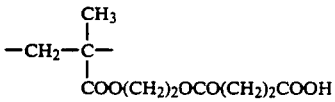 |
| A-19 | $HOCH_2CH_2$—S— | 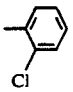 | —$C_2H_5$ | 92/8 | 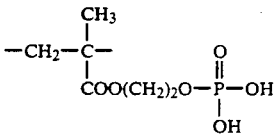 |

TABLE 3-continued

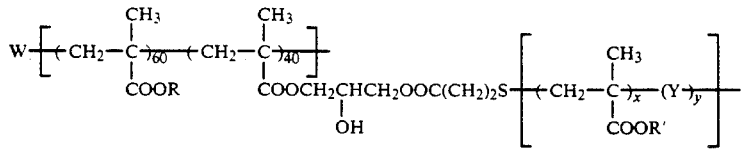

| Resin (A) | W— | R | R' | x/y (by weight) | —Y— |
|---|---|---|---|---|---|
| A-20 | HOOC—$(CH_2)_2$S— | 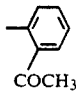 | —$C_3H_7$ | 95/5 | 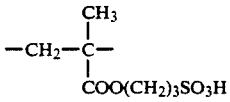 |
| A-21 | 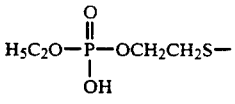 | 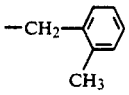 | 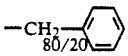 | 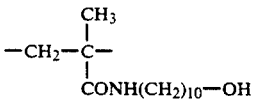 | |
| A-22 | HOOC$(CH_2)_2$S— | 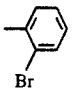 | —$C_2H_5$ | 90/10 | 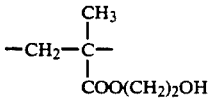 |
| A-23 | 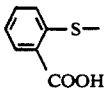 | 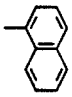 | —$C_3H_7$ | 90/10 | 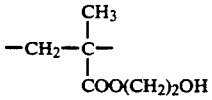 |
| A-24 | " | 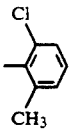 | 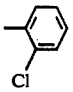 | 90/10 | 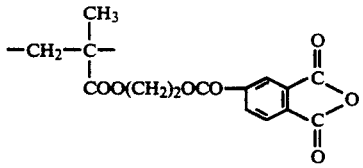 |
| A-25 | " | 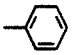 | —$CH_2C_4H_5$ | 85/15 | 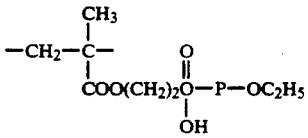 |
| A-26 | HOOC$(CH_2)_2$S— | 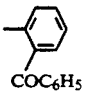 | —$C_4H_9$ | 95/5 | 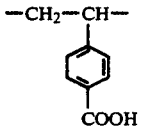 |
| A-27 | " | 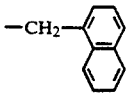 | 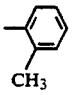 | 95/5 | 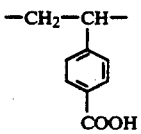 |

SYNTHESIS EXAMPLE 1 OF RESIN (B)

Synthesis of Resin B-1

A mixture of 100 g of ethyl methacrylate, 1.0 g of ethylene glycol dimethacrylate, and 200 g of toluene was heated to 75° C. in a nitrogen stream, and 1.0 g of AIBN was added thereto to conduct a reaction for 10 hours. The resulting copolymer (B-1) had a weight average molecular weight of $4.2\times10^5$.

SYNTHESIS EXAMPLES 2 TO 19 OF RESIN (B)

Synthesis of Resins B-2 to B-19

Resins (B) shown in Table 4 were prepared in the same manner as in Synthesis Example 1 of Resin (B), except for using the monomer and crosslinking monomer shown in Table 4. In Table 4, "M.W." means a weight average molecular weight.

TABLE 4

| Synthesis Example No. | Resin (B) | Monomer | | Crosslinking Monomer | | M.W. of Resin (B) |
|---|---|---|---|---|---|---|
| 2 | B-2 | ethyl methacrylate | (100 g) | propylene glycol dimethacrylate | (1.0 g) | $2.4 \times 10^5$ |
| 3 | B-3 | butyl methacrylate | (100 g) | diethylene glycol dimethacrylate | (0.8 g) | $3.4 \times 10^5$ |
| 4 | B-4 | propyl methacrylate | (100 g) | vinyl methacrylate | (3 g) | $9.5 \times 10^5$ |
| 5 | B-5 | methyl methacrylate<br>ethyl acrylate | (80 g)<br>(20 g) | divinylbenzene | (0.8 g) | $8.8 \times 10^5$ |
| 6 | B-6 | ethyl methacrylate<br>methyl acrylate | (75 g)<br>(25 g) | diethylene glycol diacrylate | (0.8 g) | $2.0 \times 10^5$ |
| 7 | B-7 | styrene<br>butyl methacrylate | (20 g)<br>(80 g) | triethylene glycol trimethacrylate | (0.5 g) | $3.3 \times 10^5$ |
| 8 | B-8 | methyl methacrylate<br>propyl methacrylate | (40 g)<br>(60 g) | IPS-22GA (produced by Okamura Seiyu K.K.) | (0.9 g) | $3.6 \times 10^5$ |
| 9 | B-9 | benzyl methacrylate | (100 g) | ethylene glycol dimethacrylate | (0.8 g) | $2.4 \times 10^5$ |
| 10 | B-10 | butyl methacrylate<br>2-hydroxyethyl methacrylate | (95 g)<br>(5 g) | ethylene glycol dimethacrylate | (0.8 g) | $2.0 \times 10^5$ |
| 11 | B-11 | ethyl methacrylate<br>acrylonitirile | (90 g)<br>(10 g) | divinylbenzene | (0.7 g) | $1.0 \times 10^5$ |
| 12 | B-12 | ethyl methacrylate<br>methacrylic acid | (99.5 g)<br>(0.5 g) | triethylene glycol dimethacrylate | (0.8 g) | $1.5 \times 10^5$ |
| 13 | B-13 | butyl methacrylate<br>phenyl methacrylate | (70 g)<br>(30 g) | diethylene glycol dimethacrylate | (1.0 g) | $2.0 \times 10^5$ |
| 14 | B-14 | ethyl methacrylate<br>acrylamide | (95 g)<br>(5 g) | triethylene glycol dimethacrylate | (1.0 g) | $2.4 \times 10^5$ |
| 15 | B-15 | propyl methacrylate<br>N,N-dimethylaminoethyl methacrylate | (92 g)<br>(8 g) | divinylbenzene | (1.0 g) | $1.8 \times 10^5$ |
| 16 | B-16 | ethyl methacrylate<br>methyl crotonate | (70 g)<br>(30 g) | divinylbenzene | (0.8 g) | $1.4 \times 10^5$ |
| 17 | B-17 | propyl methacrylate<br>diacetonacrylamide | (95 g)<br>(5 g) | propylene glycol dimethacrylate | (0.8 g) | $1.8 \times 10^5$ |
| 18 | B-18 | ethyl methacrylate<br>6-hydroxyhexamethylene methacrylate | (93 g)<br>(7 g) | ethylene glycol dimethacrylate | (0.8 g) | $2.0 \times 10^5$ |
| 19 | B-19 | ethyl methacrylate<br>2-cyanoethyl methacrylate | (90 g)<br>(10 g) | ethylene glycol dimethacrylate | (0.8 g) | $1.8 \times 10^5$ |

SYNTHESIS EXAMPLE 20 OF RESIN (B)

Synthesis of Resin B-20

A mixture of 99 g of ethyl methacrylate, 1 g of ethylene glycol dimethacrylate, 150 g of toluene, and 50 g of methanol was heated to 70° C. in a nitrogen stream, and 1.0 g of 4,4'-azobis(4-cyanopentanoic acid) was added thereto to conduct a reaction for 8 hours. The resulting copolymer (B-20) had an P average molecular weight of $1.0 \times 10^5$.

SYNTHESIS EXAMPLES 21 TO 24 OF RESIN (B)

Synthesis of Resins B-21 to B-24

Resins (B) shown in Table 5 below were prepared in the same manner as in Synthesis Example 20 of Resin (B), except for replacing 4,4'-azobis(4-cyanopentanoic acid) used as a polymerization initiator with each of the compounds shown in Table 5. The resulting resins had an average molecular weight between $1.0 \times 10^5$ and $3 \times 10^5$.

TABLE 5

| | | R—N=N— | |
|---|---|---|---|
| Synthesis Example No. | Resin (B) | Polymerization Initiator | R— |
| 21 | B-21 | 2,2'-azobis(2-cyanopropanol) | $HO-CH_2-C(CH_3)(CN)-$ |

TABLE 5-continued

| | | R—N=N— | |
|---|---|---|---|
| Synthesis Example No. | Resin (B) | Polymerization Initiator | R— |
| 22 | B-22 | 2,2'-azobis(2-cyanopentanol) | $HOCH_2CH_2CH_2-C(CH_3)(CN)-$ |
| 23 | B-23 | 2,2'-azobis[2-methyl-N-(2-hydroxyethyl)-propionamide] | $HOCH_2CH_2NH-C(=O)-C(CH_3)-$ |
| 24 | B-24 | 2,2'-azobis{2-methyl-N-[1,1-bis-hydroxymethyl)-2-hydroxyethyl]-propionamide} | $(HOCH_2)_2C(CH_2OH)-NH-C(=O)-C(CH_3)-$ |

SYNTHESIS EXAMPLE 25 OF RESIN (B)

Synthesis of Resin B-25

A mixture of 99 g of ethyl methacrylate, 1.0 g of thioglycolic acid, 2.0 g of divinylbenzene, and 200 g of toluene was heated to 80° C. with stirring in a nitrogen stream. To the mixture was added 0.8 g of 2,2'-azobis(-cyclohexane-1-carbonitrile) (hereinafter abbreviated as ACHN) to conduct a reaction for 4 hours. Then, 0.4 g of ACHN was added thereto, followed by reacting for 2 hours, and 0.2 g of ACHN was further added thereto, followed by reacting for 2 hours. The resulting polymer (B-25) had a weight average molecular weight of $1.2\times10^5$.

SYNTHESIS EXAMPLES 26 TO 38 OF RESIN (B)

Synthesis of Resins B-26 to B-38

Resins (B) shown in Table 6 were prepared in the same manner as in Synthesis Example 25 of Resin (B), except for replacing 2.0 g of divinylbenzene used as a crosslinking polyfunctional monomer with the polyfunctional monomer or oligomer shown in Table 6. In Table 6, "M.W." means a weight average molecular weight.

TABLE 6

| Synthesis Example No. | Resin (B) | Crosslinking Monomer or Oligomer | | MW |
|---|---|---|---|---|
| 26 | B-26 | ethylene glycol dimethacrylate | (2.5 g) | $2.2\times10^5$ |
| 27 | B-27 | diethylene glycol dimethacrylate | (3 g) | $2.0\times10^5$ |
| 28 | B-28 | vinyl methacrylate | (6 g) | $1.8\times10^5$ |
| 29 | B-29 | isopropenyl methacrylate | (6 g) | $2.0\times10^5$ |
| 30 | B-30 | divinyl adipate | (10 g) | $1.0\times10^5$ |
| 31 | B-31 | diallyl glutaconate | (10 g) | $9.5\times10^5$ |
| 32 | B-32 | IPS-22GA (produced by Okamura Seiyu K.K.) | (5 g) | $1.5\times10^5$ |
| 33 | B-33 | triethylene glycol diacrylate | (2 g) | $2.8\times10^5$ |
| 34 | B-34 | trivinylbenzene | (0.8 g) | $3.0\times10^5$ |
| 35 | B-35 | polyethylene glycol #400 diacrylate | (3 g) | $2.5\times10^5$ |
| 36 | B-36 | polyethylene glycol dimethacrylate | (3 g) | $2.5\times10^5$ |
| 37 | B-37 | trimethylolpropane triacrylate | (0.5 g) | $1.8\times10^5$ |
| 38 | B-38 | polyethylene glycol #600 diacrylate | (3 g) | $2.8\times10^5$ |

SYNTHESIS EXAMPLES 39 TO 49 OF RESIN (B)

Synthesis of Resins B-39 TO B-49

A mixture of 39 g of methyl methacrylate, 60 g of ethyl methacrylate, 1.0 g of each of the mercapto compounds shown in Table 7 below, 2 g of ethylene glycol dimethacrylate, 150 g of toluene, and 50 g of methanol was heated to 70° C. in a nitrogen stream. To the mixture 0.8 g of AIBN was added to conduct a reaction for 4 hours. Then, 0.4 g of AIBN was further added thereto to conduct a reaction for 4 hours. The resulting polymers had a weight average molecular weight of from $9.5\times10^4$ to $2\times10^5$.

TABLE 7

| Synthesis Example No. | Resin (B) | Mercapto Compound |
|---|---|---|
| 39 | B-39 | $CH_2COOH$ \| $HSCHCOOH$ |
| 40 | B-40 | 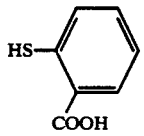 |
| 41 | B-41 | $HSCH_2CH_2NH_2$ |
| 42 | B-42 | $HSCH_2O-P(=O)(OH)-OH$ |
| 43 | B-43 | $HSCH_2CH_2O-P(=O)(OC_2H_5)-OH$ |
| 44 | B-44 | 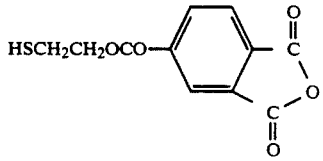 |
| 45 | B-45 | $HSCH_2CH_2COOH$ |
| 46 | B-46 | 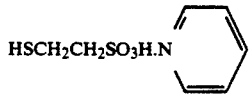 |
| 47 | B-47 | $HSCH_2CH_2NHCO(CH_2)_3COOH$ |
| 48 | B-48 | $HSCH_2CH_2N(CH_3)_2$ |
| 49 | B-49 | $HSCH_2CH_2OH$ |

EXAMPLE 1

A mixture of 6 g (solid basis, hereinafter the same) of (A-1) obtained in Synthesis Example 1 of Resin (A), 34 g (solid basis, hereinafter the same) of B-1 obtained in Synthesis Example of 1 of Resin (B), 200 g of zinc oxide, 0.15 g of heptamethinecyanine dye (A) shown below, 0.30 g of phthalic anhydride, and 300 g of toluene was dispersed in a ball mill for 3 hours to prepare a coating composition for a photoconductive layer. The coating composition was coated on paper, rendered electrically conductive, with a wire bar to a dry thickness of 20 g/m², followed by drying at 110° C. for 1 minute. The coating was allowed to stand in a dark plate at 20° C. and 65% RH (relative humidity) for 24 hours to prepare an electrophotographic light-sensitive material.

Cyanine Dye (A):

-continued

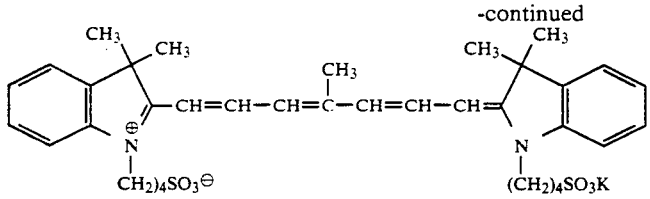

EXAMPLE 2

An electrophotographic light-sensitive material was produced in the same manner as in Example 1, except for replacing 34 g of B-1 with the same amount of B-20.

COMPARATIVE EXAMPLE A

An electrophotographic light-sensitive material was produced in the same manner as in Example 1, except for replacing 6 g of A-1 and 34 g of B-1 with 40 g of A-1.

COMPARATIVE EXAMPLE B

An electrophotographic light-sensitive material was produced in the same manner as in Comparative Example A, except for replacing 40 g of A-1 with 40 g of an ethyl methacrylate/acrylic acid copolymer (95/5 by weight) having a weight average molecular weight of 7,500 (hereinafter designated R-1).

COMPARATIVE EXAMPLE C

An electrophotographic light-sensitive material was produced in the same manner as in Comparative Example A, except for replacing 40 g of A-1 with 40 g of an ethyl methacrylate/acrylic acid copolymer (98.5/1.5 by weight) having a weight average molecular weight of 45,000.

COMPARATIVE EXAMPLE D

An electrophotographic light-sensitive material was produced in the same manner as in Example 1, except for replacing 6 g of A-1 with 6 g of R-1 as defined in Comparative Example B above.

COMPARATIVE EXAMPLE E

An electrophotographic light-sensitive material was produced in the same manner as in Example 2, except for replacing 6 g of A-1 with 6 g of R-1 as defined in Comparative Example B.

Each of the light-sensitive materials obtained in Examples 1 and 2 and Comparative Examples A to E was evaluated for film properties in terms of surface smoothness and mechanical strength; electrostatic characteristics; image forming performance; oil-desensitivity when used as an offset master plate precursor (expressed in terms of contact angle with water after oil-desensitization treatment); and printing durability when used as an offset master plate according to the following test methods. The results obtained are shown in Table 8 below.

1) Smoothness of Photoconductive Layer

The smoothness (sec/cc) was measured using a Beck's smoothness tester manufactured by Kumagaya Riko K.K. under an air volume condition of 1 cc.

2) Mechanical Strength of Photoconductive Layer

The surface of the light-sensitive material was repeatedly (1000 times) rubbed with emery paper (#1000) under a load of 50 g/cm$^2$ using a Heidon 14 Model surface testing machine (manufactured by Shinto Kagaku K.K.). After dusting, the abrasion loss of the photoconductive layer was measured to obtain film retention (%).

3) Electrostatic Characteristics

The sample was charged with a corona discharge to a voltage of −6 kV for 20 seconds in a dark room at 20° C. and 65% RH using a paper analyzer "Paper Analyzer SP-428" manufactured by Kawaguchi Denki K.K. Ten seconds after the corona discharge, the surface potential $V_{10}$ was measured. The sample was allowed to stand in the dark for an additional 180 seconds, and the potential $V_{190}$ was measured. The dark decay retention (DRR; %), i.e., percent retention of potential after dark decay for 180 seconds, was calculated from the following equation:

$$DRR\ (\%) = (V_{190}/V_{10}) \times 100$$

The measurements were conducted under conditions of 20° C. and 65% RH (hereinafter referred to as Condition I) or 30° C. and 80% RH (hereinafter referred to as Condition II).

Separately, the sample was charged to −400 V with a corona discharge and then exposed to monochromatic light having a wavelength of 780 nm, and the time required for decay of the surface potential $V_{10}$ to one-tenth was measured to obtain an exposure $E_{1/10}$ (erg/cm$^2$).

4) Image Forming Performance

After the sample was allowed to stand for one day under Condition I or II, each sample was charged to −5 kV and exposed to light emitted from a gallium-aluminum-arsenide semiconductor laser (oscillation wavelength: 780 nm; output: 2.8 mW) at an exposure amount of 64 erg/cm$^2$ (on the surface of the photoconductive layer) at a pitch of 25 μm and a scanning speed of 300 m/sec. The thus formed electrostatic latent image was developed with a liquid developer "ELP-T" produced by Fuji Photo Film Co., Ltd., followed by fixing. The reproduced image was visually evaluated for fog and image quality.

The toner image density at the solid black portion was measured with a Macbeth reflection densitometer to obtain the maximum density ($D_{max}$).

5) Contact Angle With Water

The sample was passed once through an etching processor using a n oil-desensitizing solution "ELP-E" produced by Fuji Photo Film Co., Ltd. to render the surface of the photoconductive layer oil-desensitive. On the thus oil-desensitized surface was placed a drop of 2 μl of distilled water, and the contact angle formed between the surface and water was measured using a goniometer.

6) Printing Durability

The sample was processed in the same manner as described in 4) above, and the surface of the photoconductive layer was subjected to oil-desensitization under the same conditions as in 5) above. The resulting lithographic printing plate was mounted on an offset printing machine "Oliver Model 52", manufactured by Sakurai Seisakusho K.K., and printing was carried out on fine paper. The number of prints obtained until background stains in the non-image areas appeared or the quality of the image areas was deteriorated was taken as the printing durability. The larger the number of the prints, the higher the printing durability.

The sample of Comparative Example B has a reduced DRR for 180 seconds and an increased $E_{1/10}$.

The sample of Comparative Example C, in which a binder resin whose chemical structure is the same as the copolymer used in Comparative Example B but having an increased weight average molecular weight was used, underwent considerable deterioration of electrostatic characteristics. It is thus assumed that the binder resin having an increased molecular weight is adsorbed onto photoconductive particles but also induces agglomeration of the particles to exert adverse influences on electrostatic characteristics.

The samples of Comparative Examples D and E, in which a conventional low-molecular weight random copolymer was used in place of resin (A), had reduced electrostatic characteristics (DRR and $E_{1/10}$). Actually, the reproduced image formed by using these samples suffered from deterioration.

TABLE 8

| | | Example 1 | Example 2 | Compa. Example A | Compa. Example B | Compa. Example C | Compa. Example D | Compa. Example E |
|---|---|---|---|---|---|---|---|---|
| Surface Smoothness (sec/cc) | | 120 | 125 | 125 | 120 | 45 | 120 | 120 |
| Film Strength (%) | | 89 | 97 | 63 | 60 | 65 | 90 | 98 |
| Electrostatic Characteristics: | | | | | | | | |
| $V_{10}$ (−V): | Condition I | 560 | — | 630 | 525 | 410 | 525 | 530 |
| | Condition II | 555 | — | 625 | 480 | 300 | 500 | 505 |
| DRR (%): | Condition I | 83 | 85 | 86 | 80 | 55 | 80 | 79 |
| | Condition II | 80 | 84 | 85 | 68 | 30 | 70 | 73 |
| $E_{1/10}$ (erg/cm$^2$): | Condition I | 28 | 26 | 23 | 50 | 120 | 55 | 50 |
| | Condition II | 30 | 25 | 22 | 55 | 200 or more | 60 | 56 |
| Image-Forming Performance: | | | | | | | | |
| Conditon I | | Good | Good | Good | No good to good (reduced $D_{max}$) | Poor (cuts of letters or fine lines) | No good (reduced $D_{max}$) | No good (reduced $D_{max}$) |
| Condition II | | Good | Good | Good | Poor to no good (cuts of fine lines, reduced $D_{max}$) | Very poor (background fog, remarkable cuts of fine lines) | No good to poor (cuts of fine lines, reduced $D_{max}$) | No good to poor (cuts of fine lines, reduced $D_{max}$) |
| Contact Angle With Water (°C.) | | 10 or less | 10 or less | 10 or less | 10 or less | 25–30 (widely scattered) | 10 | 11 |
| Printing Durability: | | 8,000 | 10,000 or more | 1,000 | 1,000 | Background stains from the start of printing | 8,000 | 10,000 or more |

As can be seen from the results of Table 8, each of the light-sensitive materials according to the present invention had satisfactory surface smoothness and electrostatic characteristics. When each was used as an offset master plate precursor, the reproduced image was clear and free from background stains. While not describing to be bound, these results appear to be due to sufficient adsorption of the binder resin onto the photoconductive particles and sufficient covering of the surface of the particles with the binder resin. For the same reason, oil-desensitization of the offset master plate precursor with an oil-desensitizing solution was sufficient to render the non-image areas sufficiently hydrophilic, as shown by a small contact angle of 10° or less with water. On practical printing using the resulting master plate, no background stains were observed in the prints.

The sample of Comparative Example A in which only resin (A) was employed had very satisfactory electrostatic characteristics, but when used as an offset master, the prints obtained from about the 1,000th print suffered from a deterioration in image quality.

From all these considerations, it is thus clear that an electrophotographic light-sensitive material satisfying both requirements of electrostatic characteristics and printing suitability cannot be obtained without the binder resin according to the present invention.

EXAMPLES 3 TO 26

An electrophotographic light-sensitive material was prepared in the same manner as in Example 1, except for replacing A-1 and B-1 with each of the resins (A) and (B) shown in Table 9, respectively.

The performance properties of the resulting light-sensitive materials were evaluated in the same manner as in Example 1, and the results obtained are shown in Table 9 below. The electrostatic characteristics in Table 9 are those determined under Condition II (30° C., 80% RH).

TABLE 9

| Example No. | Resin (A) | Resin (B) | $V_{10}$ (−V) | DRR (%) | $E_{1/10}$ (erg/cm$^2$) | Printing Durability |
|---|---|---|---|---|---|---|
| 3 | A-2 | B-2 | 570 | 83 | 24 | 8000 |
| 4 | A-3 | B-2 | 565 | 83 | 25 | " |
| 5 | A-4 | B-4 | 550 | 81 | 30 | " |

TABLE 9-continued

| Example No. | Resin (A) | Resin (B) | $V_{10}$ (−V) | DRR (%) | $E_{1/10}$ (erg/cm$^2$) | Printing Durability |
|---|---|---|---|---|---|---|
| 6 | A-6 | B-4 | 555 | 83 | 28 | " |
| 7 | A-7 | B-5 | 560 | 85 | 26 | 8500 |
| 8 | A-8 | B-6 | 550 | 81 | 30 | 8000 |
| 9 | A-9 | B-7 | 555 | 83 | 28 | 8500 |
| 10 | A-10 | B-7 | 550 | 82 | 27 | " |
| 11 | A-12 | B-8 | 570 | 84 | 23 | 8000 |
| 12 | A-13 | B-9 | 570 | 85 | 22 | " |
| 13 | A-15 | B-10 | 575 | 85 | 22 | 8500 |
| 14 | A-17 | B-13 | 555 | 81 | 28 | 8000 |
| 15 | A-20 | B-15 | 555 | 83 | 30 | " |
| 16 | A-21 | B-9 | 560 | 80 | 31 | " |
| 17 | A-23 | B-19 | 560 | 82 | 29 | 8500 |
| 18 | A-24 | B-20 | 575 | 85 | 22 | 10000 or more |
| 19 | A-25 | B-21 | 560 | 83 | 25 | 10000 or more |
| 20 | A-26 | B-22 | 555 | 81 | 30 | 10000 or more |
| 21 | A-27 | B-31 | 570 | 86 | 22 | 10000 or more |
| 22 | A-14 | B-34 | 560 | 84 | 26 | 10000 or more |
| 23 | A-16 | B-38 | 575 | 85 | 29 | 10000 or more |
| 24 | A-18 | B-39 | 560 | 82 | 30 | 10000 or more |
| 25 | A-19 | B-40 | 560 | 83 | 29 | 10000 or more |
| 26 | A-22 | B-43 | 565 | 83 | 27 | 10000 or more |

EXAMPLES 27 TO 45

A mixture of 6.5 g of each of resins (A) shown in Table 10 below, 33.5 g of each of resins (B) shown in Table 10, 200 g of zinc oxide, 0.05 g of Rose Bengale, 0.03 g of Tetrabromophenol Blue, 0.02 g of uranine, 0.30 g of phthalic anhydride, and 240 g of toluene was dispersed in a ball mill for 3 hours. The resulting coating composition was coated on paper, rendered conductive, with a wire bar to a dry thickness of 20 g/m$^2$, followed by heating at 110° C. for 30 seconds. The coating was allowed to stand in a dark place at 20° C. and 65% RH for 24 hours to obtain an electrophotographic light-sensitive material.

The resulting light-sensitive materials were evaluated in the same manner as in Example 1 with the following exceptions. In the evaluation of electrostatic characteristics, photosensitivity ($E_{1/10}$ (lux.sec)) was determined by charging the surface of the photoconductive layer with a corona discharge to −400 V, exposing the photoconductive layer to visible light of 2.0 lux, and measuring the time required for decreasing the surface potential ($V_{10}$) to 1/10. In the evaluation of image forming performance, the sample as a printing plate precursor was processed to form a toner image using an automatic plate making machine "ELP 404V" (manufactured by Fuji Photo Film Co., Ltd.) using a toner "ELP-T" (produced by Fuji Photo Film Co., Ltd.). The results obtained are shown in Table 10. The electrostatic characteristics in Table 10 are those determined under Condition II (30° C., 80% RH).

TABLE 10

| Example No. | Resin (A) | Resin (B) | $V_{10}$ (−V) | DRR (%) | $E_{1/10}$ (lux · sec) | Printing Durability |
|---|---|---|---|---|---|---|
| 27 | A-1 | B-2 | 565 | 93 | 9.8 | 8000 |
| 28 | A-2 | B-4 | 580 | 94 | 9.5 | " |
| 29 | A-7 | B-5 | 560 | 92 | 10.0 | " |
| 30 | A-11 | B-6 | 555 | 88 | 12.6 | " |
| 31 | A-12 | B-7 | 565 | 90 | 10.5 | 8500 |
| 32 | A-14 | B-7 | 560 | 90 | 10.2 | " |
| 33 | A-16 | B-10 | 580 | 94 | 9.6 | " |
| 34 | A-17 | B-12 | 560 | 90 | 10.4 | 8000 |
| 35 | A-18 | B-14 | 560 | 90 | 10.2 | " |
| 36 | A-22 | B-17 | 555 | 90 | 10.0 | " |
| 37 | A-1 | B-18 | 560 | 91 | 10.1 | 10000 or more |
| 38 | A-4 | B-23 | 550 | 89 | 12.0 | 10000 or more |
| 39 | A-5 | B-48 | 560 | 94 | 11.3 | 10000 or more |
| 40 | A-6 | B-2 | 560 | 90 | 10.4 | 8000 |
| 41 | A-10 | B-4 | 565 | 90 | 10.5 | " |
| 42 | A-20 | B-20 | 560 | 90 | 10.8 | 8000 |
| 43 | A-21 | B-21 | 555 | 88 | 11.1 | 10000 or more |
| 44 | A-23 | B-22 | 565 | 89 | 10.6 | 10000 or more |
| 45 | A-27 | B-48 | 575 | 93 | 9.6 | 10000 |

TABLE 10-continued

| Example No. | Resin (A) | Resin (B) | $V_{10}$ (−V) | DRR (%) | $E_{1/10}$ (lux · sec) | Printing Durability |
|---|---|---|---|---|---|---|
| | | | | | | or more |

As is apparent from the results in Table 10, each of the light-sensitive materials according to the present invention had excellent charging properties, dark charge retention, and photosensitivity, and provided a clear reproduced image free from background fog even when processed under severe conditions of high temperature and high humidity (30° C., 80% RH).

When printing was carried out using an offset master plate produced from each of the light-sensitive materials, clear prints of high quality could be obtained up to the number of prints indicated in Table 10.

As described above, the present invention provides an electrophotographic light-sensitive material having excellent electrostatic characteristics and mechanical strength.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having thereon a photoconductive layer containing at least inorganic photoconductive particles and a binder resin, wherein the binder resin contains (A) at least one resin formed from a graft copolymer having a weight average molecular weight of from $1.0\times10^3$ to $2.0\times10^4$ and containing, as copolymer components, at least (i) a monofunctional macromonomer (M) having a weight average molecular weight of not more than $2\times10^4$ and containing at least one polymer component represented by formula (IIa) or (IIb) shown below and at least one polymer component having at least one polar group selected from the group consisting of —COOH, $-PO_3H_2$, $-SO_3H$, —OH, and

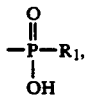

wherein $R_1$ represents a hydrocarbon group or $-OR_2$ (wherein $R_2$ represents a hydrocarbon group), with a polymerizable double bond group represented by formula (I) shown below being bonded to one terminal of the main chain thereof, and (ii) a monomer represented by formula (III) shown below, and (B) at least one resin having a weight average molecular weight of not less than $5\times10^4$, containing at least a recurring unit represented by formula (IV) shown below as a polymer component, and having a crosslinked structure

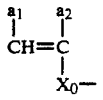

(I)

wherein $X_0$ represents —COO—, —OCO—, $-CH_2OCO-$, $-CH_2COO-$, —O—, $-SO_2-$, —CO—, —CONHCOO—, —CONHCONH—, $-CONHSO_2-$,

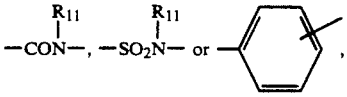

wherein $R_{11}$ represents a hydrogen atom or a hydrocarbon group; $a_1$ and $a_2$, which may be the same or different, each represents a hydrogen atom, a halogen atom, a cyano group, a hydrocarbon group, $-COO-Z_1$, or $-COO-Z_1$ bonded through a hydrocarbon group (wherein $Z_1$ represents a substituted or unsubstituted hydrocarbon group therefor);

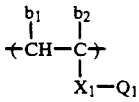

(IIa)

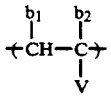

(IIb)

wherein $X_1$ has the same meaning as $X_0$; $Q_1$ represents an aliphatic group having from 1 to 18 carbon atoms or an aromatic group having from 6 to 12 carbon atoms; $b_1$ and $b_2$, which may be the same or different, each has the same meaning as $a_1$ and $a_2$; V represents —CN, $-CONH_2$, or

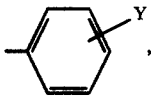

wherein Y represents a hydrogen atom, a halogen atom, a hydrocarbon group, an alkoxyl group, or $-COOZ_2$, wherein $Z_2$ represents an alkyl group, an aralkyl group, or an aryl group

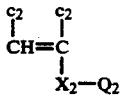

(III)

wherein $X_2$ has the same meaning as $X_0$ in formula (I); $Q_2$ has the same meaning as $Q_1$ in formula (IIa); and $c_1$ and $c_1$, which may be the same or different, have the same meaning as $a_1$ and $a_2$ in formula (I)

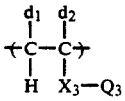

(IV)

wherein $X_3$ represents —COO—, —OCO—, $-CH_2OCO-$, $-CH_2COO-$, —O—, or $-SO_2-$, $Q_3$ represents a hydrocarbon group having from 1 to 22 carbon atoms; and $d_1$ and $d_2$, which may be the same or different, each represents a hydrogen atom, a halogen atom, a cyano group, a hydrocarbon group having from 1 to 8 carbon atoms, —COO—$Z_3$, or —COO—$Z_3$ bonded through a hydrocarbon group having from 1 to 8 carbon atoms, wherein $Z_3$ represents a hydrocarbon group having from 1 to 18 carbon atoms.

2. An electrophotographic light-sensitive material as claimed in claim 1, wherein said graft copolymer has at least one polar group selected from the group consisting of —$PO_3H_2$, —$SO_3H$, —COOH, —OH, and

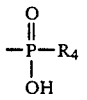

(wherein $R_4$ has the same meaning as $R_1$) at one terminal of the main chain thereof.

3. An electrophotographic light-sensitive material as claimed in claim 1, wherein said resin (B) has at least one polar group selected from the group consisting of —$PO_3H_2$, —$SO_3H$, —COOH, —OH, —SH,

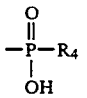

(wherein $R_4$ has the same meaning as $R_1$), a cyclic acid anhydride group-containing group, —CHO, —$CONH_2$, —$SO_2NH_2$, and

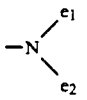

(wherein $e_1$ and $e_2$, which may be the same or different, each represents a hydrogen atom or a hydrocarbon group) at one terminal of at least one polymer chain thereof.

4. An electrophotographic light-sensitive material as claimed in claim 2, wherein said resin (B) has at least one polar group selected from the group consisting of —$PO_3H_2$, —$SO_3H$, —COOH, —OH, —SH,

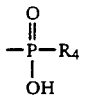

(wherein $R_4$ has the same meaning as $R_1$), a cyclic acid anhydride group-containing group, —CHO, —$CONH_2$, —$SO_2NH_2$, and

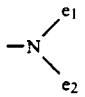

(wherein $e_1$ and $e_2$, which may be the same or different, each represents a hydrogen atom or a hydrocarbon group) at one terminal of at least one polymer main chain thereof.

5. An electrophotographic light-sensitive material as claimed in claim 1, wherein said resin (B) contains, as a polymer component, no recurring unit having the acidic group present in resin (A) or a cyclic anhydride-containing group.

6. An electrophotographic light-sensitive material as claimed in claim 2, wherein said resin (B) contains, as a polymer component, no recurring unit having the acidic group present in resin (A) or a cyclic anhydride-containing group.

7. An electrophotographic light-sensitive material as claimed in claim 3, wherein said resin (B) contains, as a polymer component, no recurring unit having the acidic group present in resin (A) or a cyclic anhydride-containing group.

8. An electrophotographic light-sensitive material as claimed in claim 1, wherein macromonomer (M) has a weight average molecular weight of from $1\times10^3$ to $2\times10^4$.

* * * * *